US010994543B2

(12) United States Patent
Kameshima et al.

(10) Patent No.: US 10,994,543 B2
(45) Date of Patent: May 4, 2021

(54) INKJET PRINTING APPARATUS AND CONTROL METHOD THEREOF

(71) Applicant: CANON KABUSHIKI KAISHA, Tokyo (JP)

(72) Inventors: Rinako Kameshima, Tachikawa (JP); Minoru Teshigawara, Saitama (JP); Yoshinori Misumi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/526,419

(22) Filed: Jul. 30, 2019

(65) Prior Publication Data

US 2020/0047501 A1 Feb. 13, 2020

(30) Foreign Application Priority Data

Aug. 7, 2018 (JP) ..... JP2018-148714

(51) Int. Cl.
*B41J 2/165* (2006.01)
*B41J 2/14* (2006.01)

(52) U.S. Cl.
CPC ..... *B41J 2/1652* (2013.01); *B41J 2/14016* (2013.01); *B41J 2/16517* (2013.01)

(58) Field of Classification Search
CPC .. B41J 2/1652; B41J 2/16517; B41J 2/14016; B41J 2/16508; B41J 2/16532; B41J 2/16535; B41J 2202/21; B41J 2202/12; B41J 2202/20; B41J 2/14072; B41J 2/1404; B41J 2/14129
See application file for complete search history.

(56) References Cited

U.S. PATENT DOCUMENTS

| | | | | |
|---|---|---|---|---|
| 7,950,769 | B2 | 5/2011 | Sakai et al. | |
| 8,123,330 | B2 | 2/2012 | Sakai et al. | |
| 8,491,087 | B2 | 7/2013 | Sakai et al. | |
| 2016/0001561 | A1* | 1/2016 | Misumi ..... | B41J 2/14072 347/26 |

FOREIGN PATENT DOCUMENTS

| | | | |
|---|---|---|---|
| JP | 2008-105364 | A | 5/2008 |
| KR | 20070025557 | A * | 3/2007 |

OTHER PUBLICATIONS

Machine Translation of KR 20070025557A, Habuka, Masahiro, "Inkjet image forming apparatus", Mar. 3, 2007, pp. 4, 6-7 (Year: 2007).*
IP.com search (Year: 2020).*

* cited by examiner

*Primary Examiner* — Lisa Solomon
(74) *Attorney, Agent, or Firm* — Venable LLP

(57) ABSTRACT

An inkjet printing apparatus includes a discharge head including orifices that discharge ink, a channel communicating with the orifices, a heating element that generates thermal energy for discharging the ink in the channel, a protection layer having a surface exposed to the channel and covering the heating element, and an electrode having a surface exposed to the channel; a tank that stores the ink to be supplied to the discharge head; an ink circulation unit that performs a circulation operation of circulating the ink between the discharge head and the tank; and a kogation removal unit that performs a removal operation of removing kogation generated around the heating element by applying a voltage between the protection layer and the electrode. The kogation removal unit performs the removal operation after the circulation operation is stopped.

14 Claims, 17 Drawing Sheets

FIG. 18A

| | START INK SUCTION | NUMBER OF DISCHARGE PULSES (TOTAL) | KOGATION REMOVAL PROCESSING CONDITION | PRINTING QUALITY | ELUTION UNIFORMITY |
|---|---|---|---|---|---|
| PRESENT EMBODI-MENT | BEFORE VOLTAGE APPLICATION | INITIAL | – | ○ | – |
| | | $0.5\times10^6$ | – | × | ○ |
| | | – | 10V,15s | ○ | |
| | | $1.0\times10^7$ | – | × | ○ |
| | | – | 10V,15s | ○ | |
| COMPARA-TIVE EXAMPLE | AFTER VOLTAGE APPLICATION | INITIAL | – | ○ | – |
| | | $0.5\times10^6$ | – | × | × |
| | | – | 10V,15s | × | |

FIG. 18B

| COUNT OF INK SUCTION | | | WHETHER REACTION IS SATISFACTORY |
|---|---|---|---|
| 0 TIMES | | | × |
| 1 TIME | SUCTION TIMING AFTER START OF VOLTAGE APPLICATION | AFTER 5 sec. | × |
| | | AFTER 10 sec. | ○ |
| | | AFTER 15 sec. | ○ |
| | | AFTER 20 sec. | ○ |
| | | AFTER 25 sec. | × |

INKJET PRINTING APPARATUS AND CONTROL METHOD THEREOF

BACKGROUND OF THE INVENTION

Field of the Invention

The present invention relates to an inkjet printing apparatus and a control method thereof.

Description of the Related Art

Conventionally, a type of liquid discharge device heats a liquid in a liquid chamber by energizing a heat generating resistor, causes film boiling of the liquid, and discharges a droplet from an orifice by bubbling energy at this time. In a liquid discharge device of this type, a physical action of impact by cavitation generated when a liquid bubbles and the bubbles shrink and disappear is sometimes exerted on an area on the heat generating resistor. Since the heat generating resistor is hot when discharging the liquid, a chemical action of thermal decomposition, attachment, fixation, and deposition of the liquid component is sometimes exerted on an area on the heat generating resistor. To protect the heat generating resistor from the physical action or chemical action on the heat generating resistor, a protection layer formed from a metal material or the like to cover the heat generating resistor is arranged on the heat generating resistor.

At a heat acting portion of the protection layer on the heat generating resistor that contacts the liquid, a color material, additive, and the like contained in the liquid are decomposed on the molecular level upon high-temperature heating, change into a hardly-soluble substance, and are physically adsorbed on the heat acting portion. This phenomenon is called "kogation". When a hardly-soluble organic or inorganic substance is adsorbed on the heat acting portion of the protection layer, heat conduction from the heat acting portion to the liquid becomes uneven and bubbling becomes unstable.

As a measure against kogation, Japanese Patent Laid-Open No. 2008-105364 discloses a method of removing kogation by eluting the surface of a covering portion formed from iridium or ruthenium into a liquid by an electrochemical reaction. More specifically, a cleaning method is disclosed in which voltage application to an upper protection layer to elute the upper protection layer by an electrochemical reaction is performed after the start of an ink suction operation. According to this method, bubbles generated by an electrochemical reaction do not grow large and are discharged by ink suction, so kogation can be removed uniformly and reliably.

However, when the related art is applied to an inkjet printer that uses ink circulation inside a head or between a tank and a head, even bubbles generated at the time of potential control are circulated along with ink circulation. As a result, the bubbles may flow from orifices into a common ink channel on the rear surface of a chip. It is difficult to remove the bubbles flowing into the ink channel back from the orifices, and the possibility of a discharge failure by the bubbles rises. In the inkjet printer using ink circulation within the head, ink may be kept circulated while the apparatus is active, in order to implement stable discharge and suppress nozzle fixation.

SUMMARY OF THE INVENTION

The present invention enables removal of kogation on the element substrate of a liquid discharge head and implements stable discharge for a longer term while implementing stable discharge by circulating ink.

According to one aspect of the present invention, there is provided an inkjet printing apparatus comprising: a discharge head including orifices configured to discharge ink, a channel communicating with the orifices, a heating element configured to generate thermal energy for discharging the ink in the channel, a protection layer having a surface exposed to the channel and covering the heating element, and an electrode having a surface exposed to the channel; a tank configured to store the ink to be supplied to the discharge head; an ink circulation unit configured to perform a circulation operation of circulating the ink between the discharge head and the tank; and a kogation removal unit configured to perform a removal operation of removing kogation generated around the heating element by applying a voltage between the protection layer and the electrode, wherein the kogation removal unit performs the removal operation after the circulation operation is stopped.

According to one aspect of the present invention, there is provided a method of controlling an inkjet printing apparatus including a discharge head including orifices configured to discharge ink, a channel communicating with the orifices, a heating element configured to generate thermal energy for discharging the ink in the channel, a protection layer having a surface exposed to the channel and covering the heating element, and an electrode having a surface exposed to the channel, and a tank configured to store the ink to be supplied to the discharge head, the method comprising: performing a circulation operation of circulating the ink between the discharge head and the tank; and performing a removal operation on kogation generated around the heating element by applying a voltage between the protection layer and the electrode after the performing the circulation operation is stopped.

According to the present invention, removal of kogation on the element substrate of a liquid discharge head is enabled, and stable discharge can be implemented for a longer term while implementing stable discharge by circulating ink.

Further features of the present invention will become apparent from the following description of exemplary embodiments (with reference to the attached drawings).

BRIEF DESCRIPTION OF THE DRAWINGS

FIGS. 18A and 18B are tables for explaining experimental results.

DESCRIPTION OF THE EMBODIMENTS

Embodiments of the present invention will now be described with reference to the accompanying drawings. The following description does not limit the claims of the present invention.

The following embodiments will be described using a thermal inkjet printing apparatus (printing apparatus) in a form in which a liquid such as ink is circulated between a tank and a liquid discharge device (liquid discharge head). The following embodiments will also be described using a so-called line head having a length corresponding (equivalent) to the width of a print medium. However, the present invention is not limited to this arrangement and is applicable to even a so-called serial liquid discharge device configured to print while scanning a print medium. The serial liquid discharge device has, for example, an arrangement in which printing element substrates are mounted for black ink and color inks, respectively. The serial liquid discharge device is not limited to this arrangement and may have a form in which a line head shorter than the width of a print medium is formed by arranging several printing element substrates in the orifice line direction so that orifices overlap each other, and the line head is scanned with respect to a print medium.

First Embodiment (Inkjet Printing Apparatus)

Figure 1:
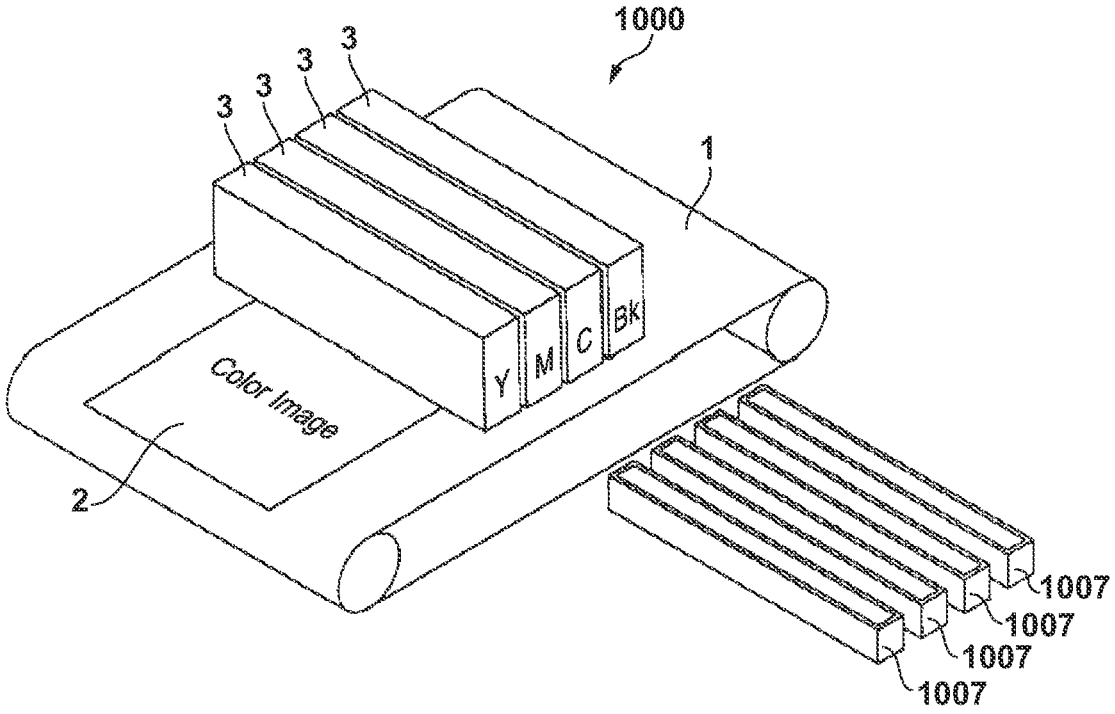
FIG. 1 is a view of the schematic arrangement of a printing apparatus.

FIG. 1 shows a schematic arrangement around liquid discharge heads 3 in an inkjet printing apparatus (to be also referred to as a printing apparatus hereinafter) configured to print by discharging ink according to the first embodiment. A printing apparatus 1000 includes a conveying unit 1 configured to convey a print medium 2, and the line liquid discharge heads 3 arranged almost perpendicular to the conveyance direction of the print medium 2. The printing apparatus 1000 is a line printing apparatus configured to perform continuous printing by one pass while conveying a plurality of print media 2 continuously or intermittently. The print medium 2 is a printing medium such as paper. The print medium 2 is not limited to a cut sheet and may be continuous roll paper. The printing apparatus 1000 includes four liquid discharge heads 3 for single colors corresponding to four types of C, M, Y, and K (Cyan, Magenta, Yellow, blacK) inks I. Note that the number of liquid discharge heads 3 is not limited to four and can be increased/decreased in accordance with the types of corresponding inks or the number of colors. The printing apparatus 1000 includes caps 1007. At the time of non-printing, the caps 1007 cover the orifice surface sides of the liquid discharge heads 3 to prevent evaporation of ink from orifices. Note that the shape of the cap 1007 is not limited to one shown in FIG. 1 and may have another shape. One cap 1007 may correspond to one liquid discharge head 3 or one cap 1007 may be provided for all the liquid discharge heads 3.

(Control System)

Figure 2:
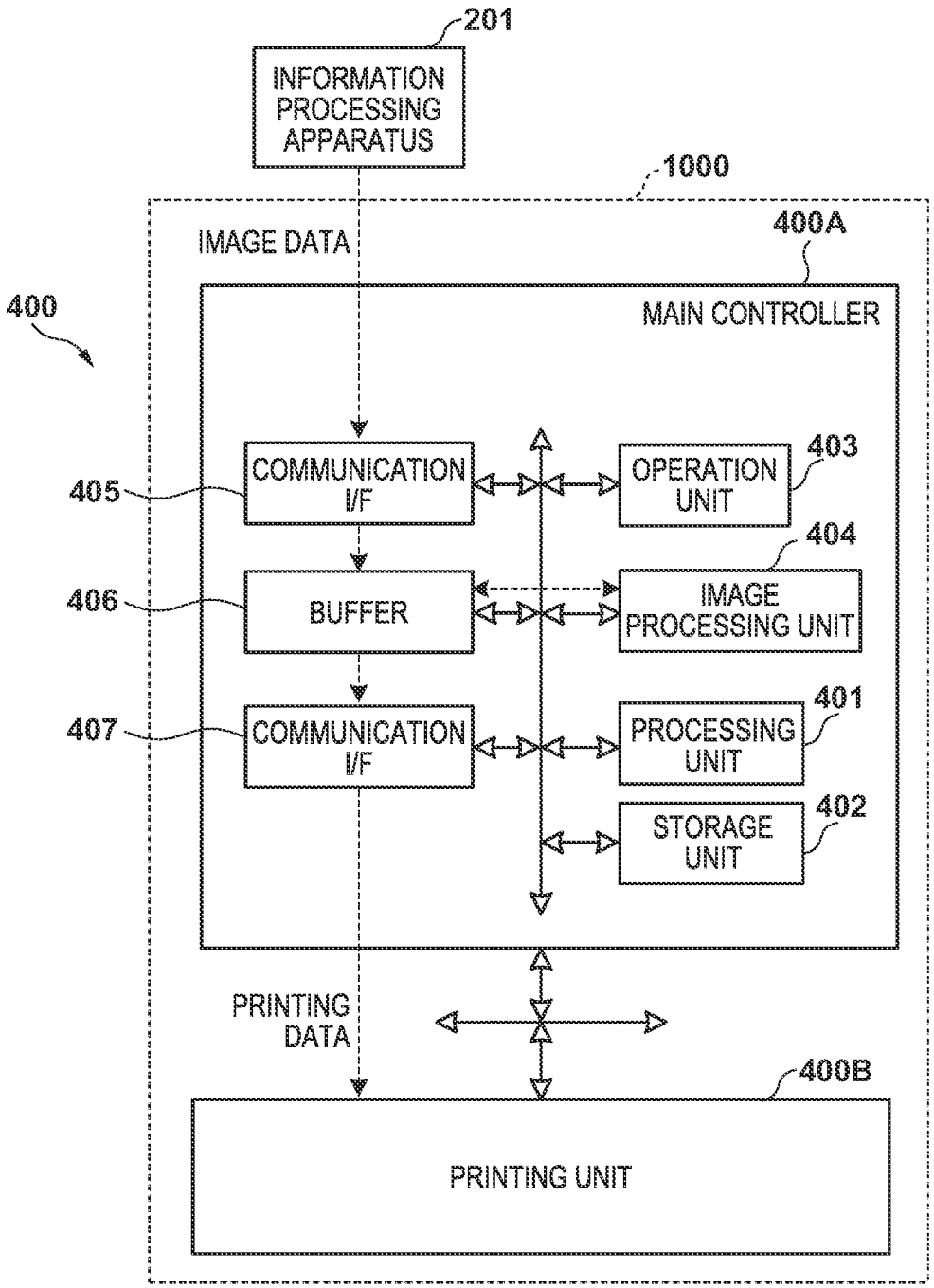
FIG. 2 is a block diagram of the control system of the printing apparatus.

An arrangement regarding the control of the printing apparatus 1000 will be described next. FIG. 2 is a block diagram of a control unit 400 of the printing apparatus 1000 according to this embodiment. The control unit 400 is connected to an information processing apparatus 201 serving as an external apparatus so that they can communicate with each other. The information processing apparatus 201 may be, for example, a PC (Personal Computer) or a server apparatus. A communication method between the apparatuses can be wired or wireless communication and is not particularly limited.

The information processing apparatus 201 generates or saves original data serving as the base of a printing image. The original data is generated in, for example, the form of an electronic file such as a document file or an image file. The original data is converted into a data format (for example, RGB data expressing an image by RGB) available in the control unit 400. The control unit 400 starts a printing operation based on the converted image data.

In this embodiment, the control unit 400 is roughly divided into a main controller 400A and a printing unit 400B. The main controller 400A includes a processing unit 401, a storage unit 402, an operation unit 403, an image processing unit 404, a communication I/F (InterFace) 405, a buffer 406, and a communication I/F 407.

The processing unit 401 is a processor such as a CPU (Central Processing Unit). The processing unit 401 executes a program stored in the storage unit 402 and controls the overall main controller 400A. The storage unit 402 is a storage device such as a RAM, a ROM, a hard disk, or a SSD. The storage unit 402 stores data and programs to be executed by the processing unit 401 and provides a work area to the processing unit 401. An external storage unit may be further provided in addition to the storage unit 402. The operation unit 403 is, for example, an input device including a touch panel, a keyboard, and a mouse, and accepts a user instruction. The operation unit 403 may be configured by, for example, integrating an input unit and a display unit. Note that a user operation is not limited to an input via the operation unit 403, and an instruction may be accepted from, for example, the information processing apparatus 201.

The image processing unit 404 is, for example, an electronic circuit having an image processor. The buffer 406 is, for example, a RAM, a hard disk, or a SSD. The communication I/F 405 communicates with the information processing apparatus 201, and the communication I/F 407 communicates with the printing unit 400B. In FIG. 2, broken line arrows exemplify flows of processing of image data. Image data received from the information processing apparatus 201 via the communication I/F 405 is stored in the buffer 406. The image processing unit 404 reads out the image data from the buffer 406, performs predetermined image processing on the readout image data, and stores it again in the buffer 406. The image data stored in the buffer 406 after the image processing is transmitted from the communication I/F 407 to the printing unit 400B as printing data used in a print engine. The printing unit 400B performs image formation using the printing data received from the main controller 400A. The printing unit 400B performs discharge control of the liquid discharge head 3 and recovery control, which will be described later.

(First Circulation Path)

Figure 3:
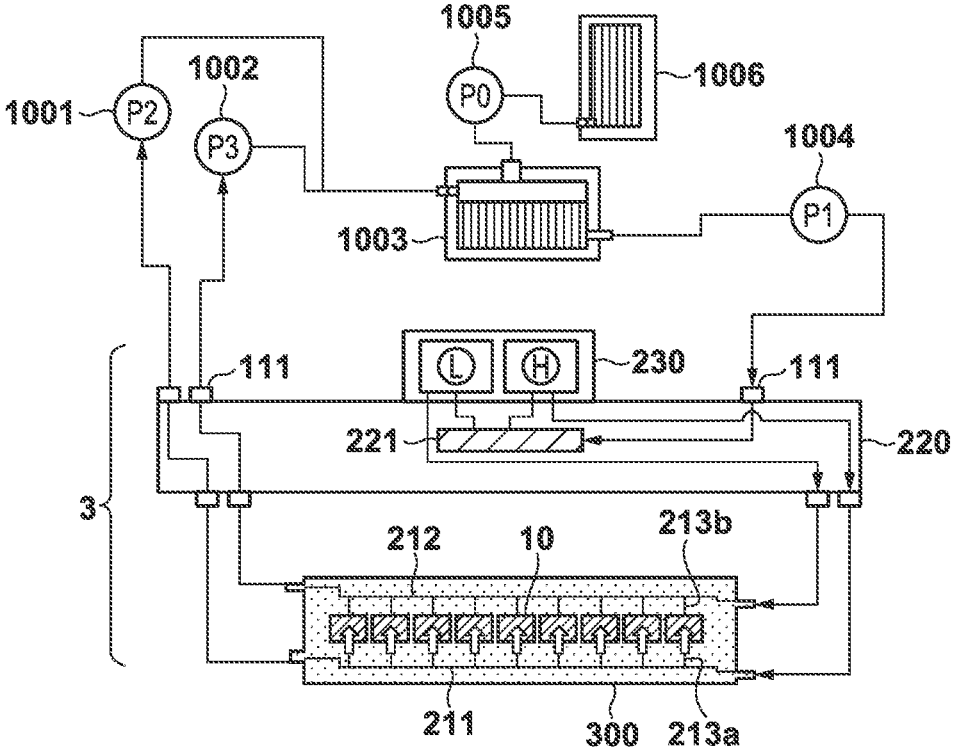
FIG. 3 is a schematic view showing a first circulation path.

FIG. 3 is a schematic view showing the first circulation path serving as one form of a circulation path applied to the printing apparatus 1000 according to this embodiment. FIG. 3 is a view showing a fluid connection including the liquid discharge head 3, a first circulation pump (high-pressure side) 1001, a first circulation pump (low-pressure side) 1002, and a buffer tank 1003. For descriptive convenience, FIG. 3 shows only a path through which ink of one color out of C, M, Y, and K inks flows. In practice, circulation paths are provided in the main body of the printing apparatus 1000 by the number of inks (four colors in a configuration example shown in FIG. 1) supported by the printing apparatus 1000. The buffer tank 1003 functions as a sub-tank in which ink is stored, and is connected to a main tank 1006. The buffer tank 1003 has an air communication port (not shown) through which the inside and outside of the tank communicate with each other, and can discharge bubbles in ink outside. The buffer tank 1003 is also connected to a replenishment pump 1005. The replenishment pump 1005 is used to transfer a consumption amount of ink from the main tank 1006 to the buffer tank 1003 when the liquid discharge head 3 consumes the ink by discharging it from the orifices of the liquid discharge head 3 for printing, suction recovery, or the like.

Both the first circulation pump (high-pressure side) 1001 and first circulation pump (low-pressure side) 1002 have a function of sucking out ink from connecting portions 111 of the liquid discharge head 3 and supplying it to the buffer tank 1003. The first circulation pump 1001 is preferably a positive-displacement pump having quantitative liquid transfer capability. Examples of the pump are a tube pump, a gear pump, a diaphragm pump, and a syringe pump. However, for example, a general constant flow valve or a relief valve may be arranged at the pump outlet to ensure a constant flow rate. When the liquid discharge head 3 is driven, a predetermined amount of ink flows through a common supply channel 211 and a common collection channel 212 by the first circulation pump (high-pressure side) 1001 and the first circulation pump (low-pressure side) 1002. This flow rate is preferably set so a temperature difference between printing element substrates 10 in the liquid discharge head 3 does not influence the printing quality. If an excessively high flow rate is set, a negative pressure difference between the printing element substrates 10 becomes excessively large under the influence of the pressure drop of the channel in a discharge unit 300, causing density non-uniformity of an image. To prevent this, the flow rate is preferably set in consideration of the temperature difference and negative pressure difference between the printing element substrates 10.

A negative-pressure control unit 230 is provided on a path between a second circulation pump 1004 and the discharge unit 300. The negative-pressure control unit 230 has a function of operating to maintain a pressure on the downstream side (that is, the discharge unit 300 side) of the negative-pressure control unit 230 at a preset constant value even when the flow rate of the circulation system varies owing to the difference of the printing duty. The difference of the duty means the difference of the discharge amount within the range of discharge from the discharge unit 300.

Two pressure regulation mechanisms constituting the negative-pressure control unit 230 are arbitrary as long as a pressure on the downstream side of the negative-pressure control unit 230 can be controlled within a predetermined range of variations or less centered at a desired set pressure. For example, a mechanism similar to a so-called "pressure reducing regulator" can be employed. When the pressure reducing regulator is used, the second circulation pump 1004 preferably pressurizes the upstream side of the negative-pressure control unit 230 via a supply unit 220, as shown in FIG. 3. This arrangement can suppress the influence of the water head pressure of the buffer tank 1003 on the liquid discharge head 3, and can increase the degree of freedom of the layout of the buffer tank 1003 in the printing apparatus 1000. The second circulation pump 1004 suffices to have a predetermined pump head pressure or more within the range of an ink circulation flow rate used at the time of driving the liquid discharge head 3. A turbo pump, a positive-displacement pump, or the like is available. More specifically, a diaphragm pump or the like is applicable as the second circulation pump 1004. Instead of the second circulation pump 1004, for example, a water head tank arranged with a predetermined water head difference from the negative-pressure control unit 230 is also applicable.

As shown in FIG. 3, the negative-pressure control unit 230 includes two pressure regulation mechanisms for which different control pressures are set respectively. Of the two negative-pressure regulation mechanisms, a relatively high-pressure setting side (H in FIG. 3) and a relatively low-pressure side (L in FIG. 3) are connected to the common supply channel 211 and the common collection channel 212 in the discharge unit 300 via the supply unit 220, respectively. The discharge unit 300 includes the common supply channel 211, the common collection channel 212, and individual supply channels 213*a* and individual collection channels 213*b* communicating with the corresponding printing element substrates 10. The individual supply channels 213*a* and the individual collection channels 213*b* are also referred to as individual channels 213 collectively. Since the individual channels 213 communicate with the common supply channel 211 and the common collection channel 212, a flow (white arrows in FIG. 3) is generated in which part of ink flows from the common supply channel 211 to the common collection channel 212 via the internal channels of the printing element substrates 10. This is because the pressure regulation mechanism H is connected to the common supply channel 211, the pressure regulation mechanism L is connected to the common collection channel 212, and a pressure difference is generated between the two common channels.

In this manner, a flow is generated in the discharge unit 300, in which part of ink passes through each printing element substrate 10 while supplying ink to pass through the common supply channel 211 and the common collection channel 212. Heat generated in the printing element substrate 10 can be discharged outside the printing element substrate 10 by the flow through the common supply channel 211 and the common collection channel 212. With this arrangement, when the liquid discharge head 3 performs printing, a flow of ink can be generated even at an orifice or pressure chamber at which no printing is performed, and thickening of ink at this portion can be suppressed. In addition, thickened ink or a foreign substance in the ink can be discharged to the common collection channel 212. Thus, the liquid discharge head 3 according to this embodiment can perform high-speed, high-quality printing.

(Second Circulation Path)

Figure 4:
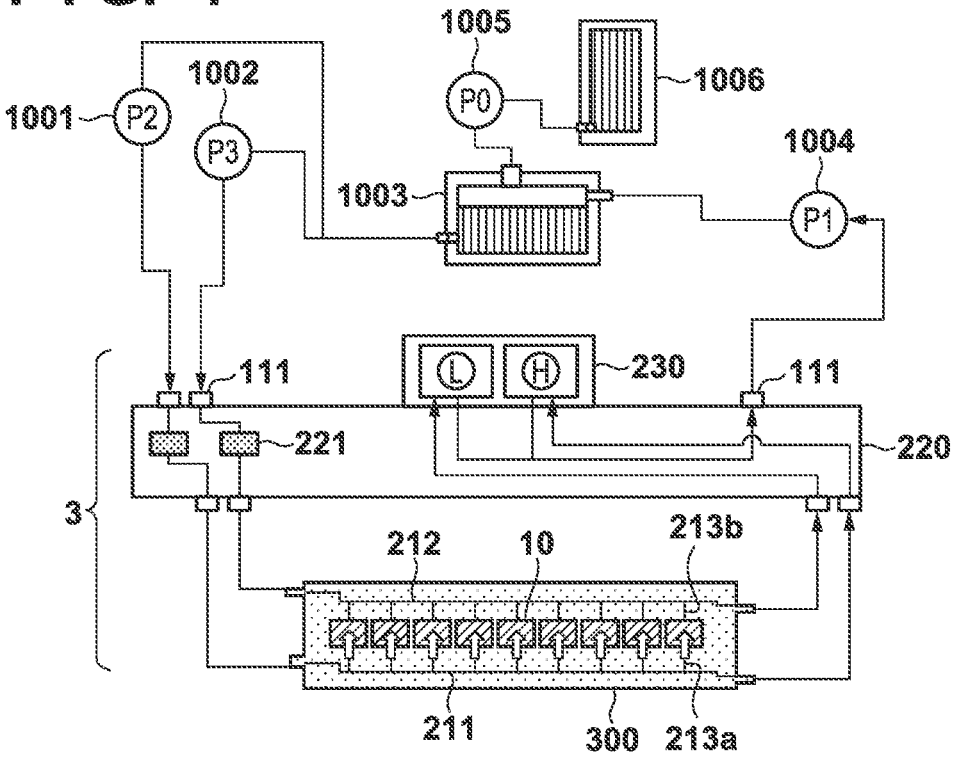
FIG. 4 is a schematic view showing a second circulation path.

FIG. 4 is a schematic view showing the second circulation path which is a circulation form different from the above-described first circulation path, out of circulation paths applied to the printing apparatus 1000 according to this embodiment. A main difference from the above-described first circulation path is that two pressure regulation mechanisms constituting the negative-pressure control unit 230 control a pressure on the upstream side of the negative-pressure control unit 230 within a predetermined range of variations centered at a desired set pressure. The two pressure regulation mechanisms are mechanism components having the same action as a so-called "back-pressure regulator". Another difference is that the second circulation pump 1004 acts as a negative-pressure source that reduces a pressure on the downstream side of the negative-pressure control unit 230. Still another difference is that the first circulation pump (high-pressure side) 1001 and the first circulation pump (low-pressure side) 1002 are arranged on the upstream side of the liquid discharge head 3 on the circulation path of ink and the negative-pressure control unit 230 is arranged on the downstream side of the liquid discharge head 3.

The negative-pressure control unit 230 operates to stabilize variations of a pressure on the upstream side (that is, the discharge unit 300) of the negative-pressure control unit 230 within a predetermined range centered at a preset pressure even if the flow rate varies along with a change of the printing duty when the liquid discharge head 3 performs printing. As shown in FIG. 4, the second circulation pump 1004 preferably pressurizes the downstream side of the negative-pressure control unit 230 via the supply unit 220. This arrangement can suppress the influence of the water head pressure of the buffer tank 1003 on the liquid discharge head 3, and can give a wide choice of the layout of the buffer tank 1003 in the printing apparatus 1000. Instead of the second circulation pump 1004, for example, a water head tank arranged with a predetermined water head difference from the negative-pressure control unit 230 is also applicable.

Similar to the first circulation path, the negative-pressure control unit 230 includes two pressure regulation mechanisms for which different control pressures are set respectively, as shown in FIG. 4. Of the two negative-pressure regulation mechanisms, a high-pressure setting side (H in FIG. 4) and a low-pressure side (L in FIG. 4) are connected to the common supply channel 211 and the common collection channel 212 in the discharge unit 300 via the supply unit 220, respectively. The two negative-pressure regulation mechanisms set the pressure of the common supply channel 211 to be higher than that of the common collection channel 212. This generates a flow in which ink flows from the common supply channel 211 to the common collection channel 212 via the individual channels 213 and the internal channels of the printing element substrates 10 (white arrows in FIG. 4).

Although an ink flow state similar to that on the first circulation path is obtained in the discharge unit 300 on the second circulation path, the second circulation path has two advantages different from the case of the first circulation path. The first advantage is little fear of an inflow of dust or a foreign substance generated from the negative-pressure control unit 230 into the head because the negative-pressure control unit 230 is arranged on the downstream side of the liquid discharge head 3 on the second circulation path.

The second advantage is that the maximum value of a necessary flow rate of ink supplied from the buffer tank 1003 to the liquid discharge head 3 is smaller on the second circulation path than that on the first circulation path because of the following reason. Let A be the sum of flow rates in the common supply channel 211 and the common collection channel 212 when ink circulates at the time of printing standby. The value A is defined as a minimum flow rate necessary to make a temperature difference in the discharge unit 300 fall within a desired range when temperature adjustment of the liquid discharge head 3 is performed during printing standby. Also, let F be a discharge flow rate when ink is discharged from all the orifices of the discharge unit 300 (at the time of full discharge). In the case of the first circulation path (FIG. 3), the set flow rate of the first circulation pump (high-pressure side) 1001 and first circulation pump (low-pressure side) 1002 is A, and the maximum value of a necessary ink supply amount to the liquid discharge head 3 at the time of full discharge is A+F.

In the case of the second circulation path (FIG. 4), a necessary ink supply amount to the liquid discharge head 3 at the time of printing standby is A. A necessary supply amount to the liquid discharge head 3 at the time of full discharge is the flow rate F. In the case of the second circulation path, the sum of the set flow rates of the first circulation pump (high-pressure side) 1001 and first circulation pump (low-pressure side) 1002, that is, the maximum value of the necessary supply flow rate is a larger one of A and F. For this reason, the maximum value (A or F) of the necessary supply amount on the second circulation path always becomes smaller than the maximum value (A+F) of the necessary supply amount on the first circulation path as long as the discharge unit 300 of the same arrangement is used. In the case of the second circulation path, the degree of freedom of an applicable circulation pump increases. For example, a low-cost circulation pump with a simple arrangement can be used, or the load of a cooler (not shown) provided on a path on the main body side can be reduced. As a result, the cost of the printing apparatus main body can be reduced. This advantage is great for a line head in which the value A or F is relatively large, and greater for a line head longer in the longitudinal direction among line heads.

In some respects, the first circulation path is superior to the second circulation path. More specifically, the flow rate of ink flowing in the discharge unit 300 is maximum at the time of printing standby on the second circulation path, and a higher negative pressure is applied to each nozzle for an image of a lower printing duty. Particularly when the channel width (length in a direction perpendicular to the ink flow direction) of the common supply channel 211 and common collection channel 212 is decreased to decrease the head width (length of the liquid discharge head in the widthwise direction), a high negative pressure is applied to the nozzle for a low-duty image in which non-uniformity stands out. Accordingly, the influence of satellite droplets may become serious. In the case of the first circulation path, however, a high negative pressure is applied to the nozzle when forming a high-duty image. Even if satellite droplets are generated, they are hardly recognized and the influence on an image is small. A preferable one of the two circulation paths can be selected in consideration of the specifications of the liquid discharge head and the main body of the printing apparatus 1000 (discharge flow rate F, minimum circulation flow rate A, and channel resistance in the head). By providing such ink channels, ink can be circulated between the inside and outside of the liquid discharge head 3 in the printing apparatus 1000.

(Liquid Discharge Head)

Figure 5A:
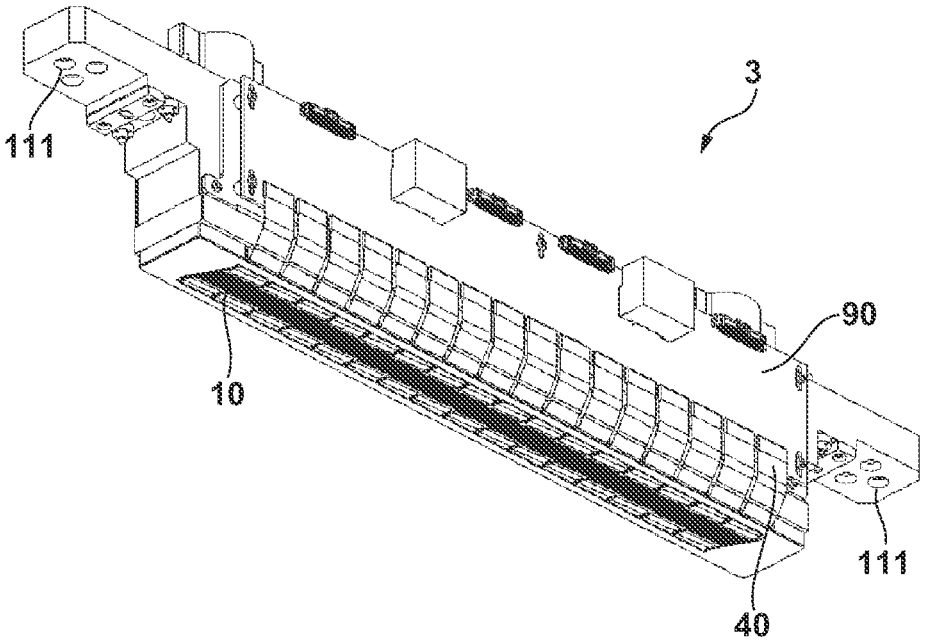
FIGS. 5A and 5B are perspective views of a liquid discharge head.
Figure 5B:
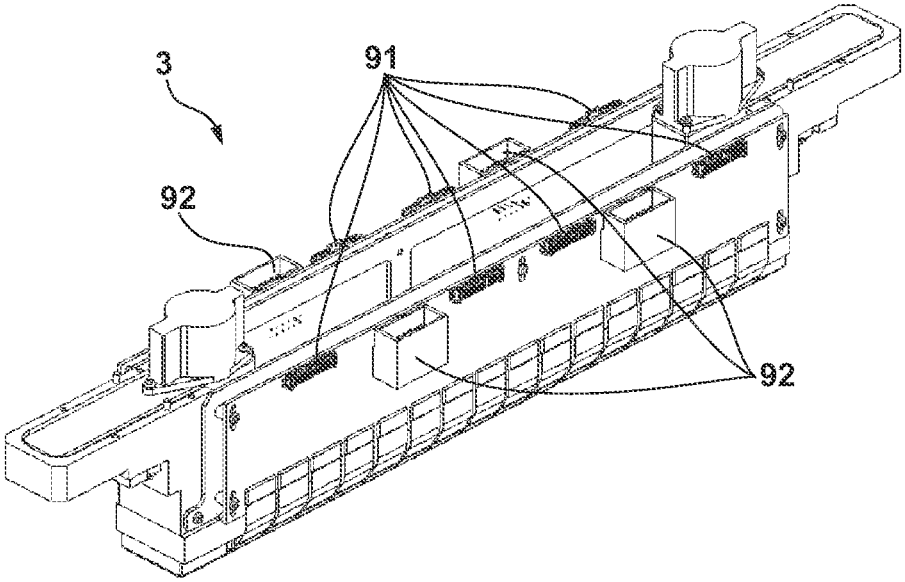

The arrangement of the liquid discharge head 3 according to the first embodiment will be described. FIGS. 5A and 5B are perspective views of the liquid discharge head 3 according to this embodiment when viewed from different directions. The liquid discharge head 3 according to this embodiment is a line liquid discharge head in which 16 printing element substrates 10 each capable of discharging ink of one color are arrayed on a straight line (arranged inline) on one printing element substrate 10. The liquid discharge heads 3 configured to discharge ink of each color have similar arrangements. Note that the number of printing element substrates 10 is not limited to the above-described one, and the printing element substrates 10 can be provided in accordance with the width of the print medium 2 supported by the printing apparatus 1000, or the like.

As shown in FIG. 5A, the liquid discharge head 3 includes the printing element substrates 10, flexible wiring boards 40, and electric wiring substrate 90 having signal input terminals 91 and power supply terminals 92. The signal input terminals 91 and the power supply terminals 92 are electrically connected to the control unit of the printing apparatus 1000, and supply discharge driving signals and power necessary for discharge to the printing element substrates 10. Since wires are collected by electrical circuits in the electric wiring substrate 90, the numbers of signal input terminals 91 and power supply terminals 92 can become smaller than the number of printing element substrates 10. The number of electrical connecting units that need to be disconnected when mounting the liquid discharge head 3 on the printing apparatus 1000 or when replacing the liquid discharge head 3 becomes small. The connecting portions 111 provided at two ends of the liquid discharge head 3 are connected to the ink supply system of the printing apparatus 1000. Ink is supplied from the supply system of the printing apparatus 1000 to the liquid discharge head 3 via one connecting portion 111, and the ink having passed through the liquid discharge head 3 is collected to the supply system of the printing apparatus 1000 via the other connecting portion 111. The liquid discharge head 3 is configured so that ink can be circulated via the path of the printing apparatus 1000 and the path of the liquid discharge head 3.

Figure 6:
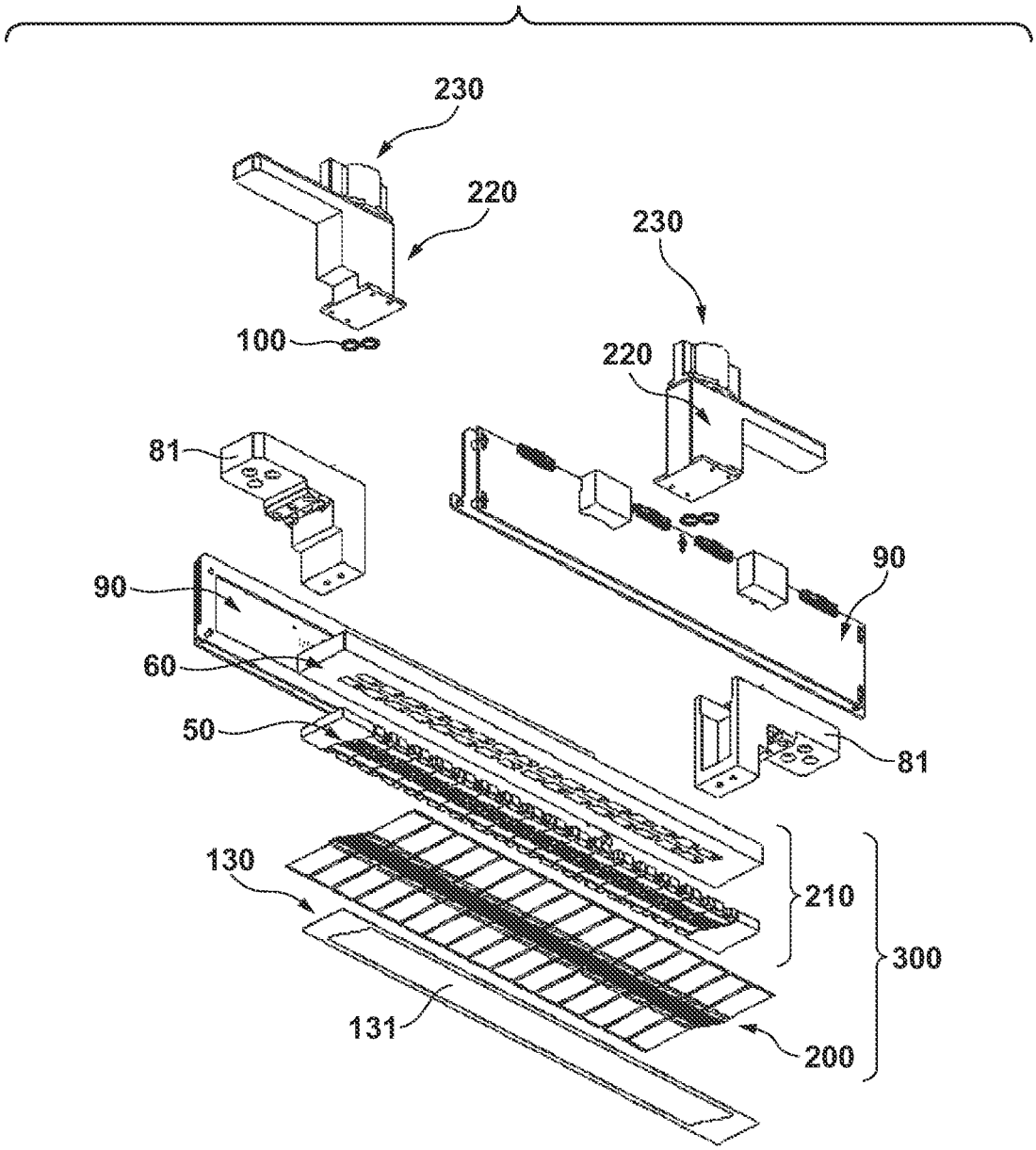
FIG. 6 is an exploded perspective view of the liquid discharge head.

FIG. 6 is an exploded perspective view of components or units constituting the liquid discharge head 3. The liquid discharge head 3 includes the discharge unit 300, the supply units 220, the electric wiring substrate 90, and discharge unit supports 81.

In the liquid discharge head 3 according to this embodiment, a second channel member 60 included in the discharge unit 300 ensures the rigidity of the liquid discharge head 3. The discharge unit supports 81 in this embodiment are connected to the two ends of the second channel member 60, and the discharge unit 300 is mechanically coupled to the carriage (not shown) of the printing apparatus 1000 to position the liquid discharge head 3. The supply units 220 each including the negative-pressure control unit 230, and the electric wiring substrate 90 are coupled to the discharge unit supports 81. Each of the two supply units 220 incorporates a filter (FIGS. 3 and 4). The two negative-pressure control units 230 are set to control the pressure by relatively high and low different negative pressures. When the negative-pressure control units 230 on the high- and low-pressure sides are installed respectively at the two ends of the liquid discharge head 3, as shown in FIG. 6, flows of ink in the common supply channel 211 and common collection channel 212 extending in the longitudinal direction of the liquid discharge head 3 are opposite to each other. This promotes heat exchange between the common supply channel 211 and the common collection channel 212 and reduces a temperature difference between the two common channels. A temperature difference between the printing element substrates 10 provided along the common channels is decreased, and printing non-uniformity by the temperature difference hardly occurs.

The discharge unit 300 includes a plurality of discharge modules 200 and a channel member 210, and a cover member 130 is attached to a surface of the discharge unit 300 on the print medium 2 side. The cover member 130 is a member having a long opening 131, as shown in FIG. 6. The printing element substrates 10 and sealing members 110 (FIG. 10A) included in the discharge modules 200 are exposed from the opening 131. A frame around the opening 131 serves as a contact surface that comes into contact with the cap 1007 (FIG. 1) configured to cap the liquid discharge head 3 at the time of printing standby. It is preferable that an adhesive, a sealer, a filler, or the like is applied along the periphery of the opening 131 to fill steps or gaps on the orifice surface side of the discharge unit 300, and a closed space is formed on the inner side of the cap 1007 in a state in which the liquid discharge head 3 is capped.

Next, details of the channel member 210 of the discharge unit 300 will be explained. The channel member 210 is constituted by stacking first channel members 50 and the second channel member 60, and distributes ink supplied from the supply unit 220 to the respective discharge modules 200. The channel member 210 functions as a channel member for returning, to the supply unit 220, ink flowing back from the discharge modules 200. The second channel member 60 of the channel member 210 is a channel member in which the common supply channel 211 and the common collection channel 212 are formed, and has a function of mainly ensuring the rigidity of the liquid discharge head 3. To achieve this, the material of the second channel member 60 preferably has corrosion resistance to ink and high mechanical strength. For example, SUS (stainless steel), Ti (titanium), or alumina can be used preferably.

Figure 7A:
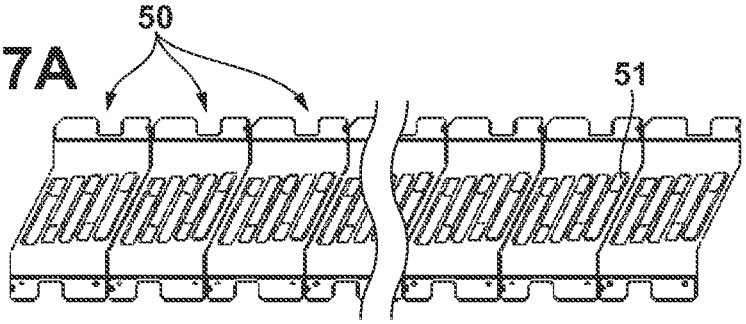
FIGS. 7A to 7E are views showing a channel member.
Figure 7B:
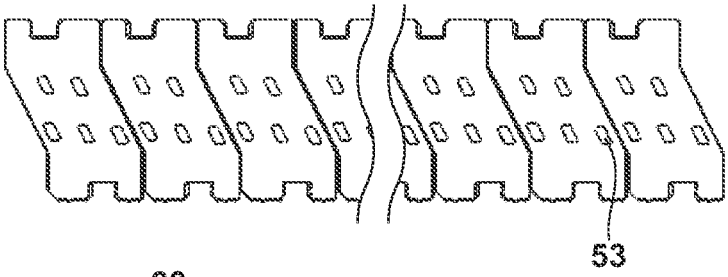
Figure 7C:
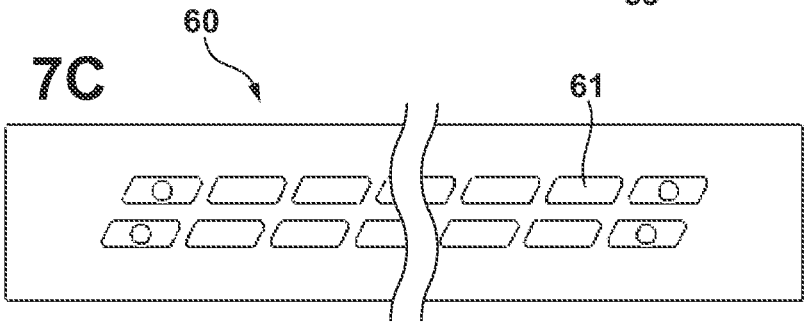
Figure 7D:
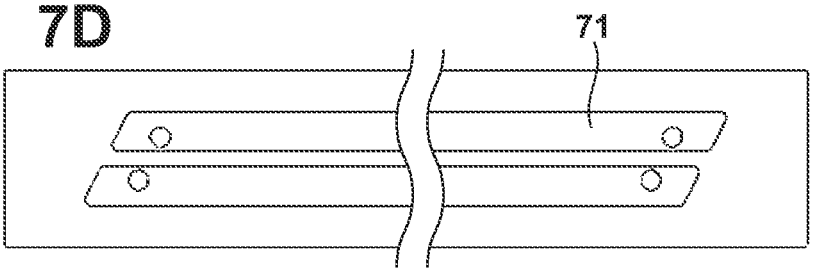
Figure 7E:
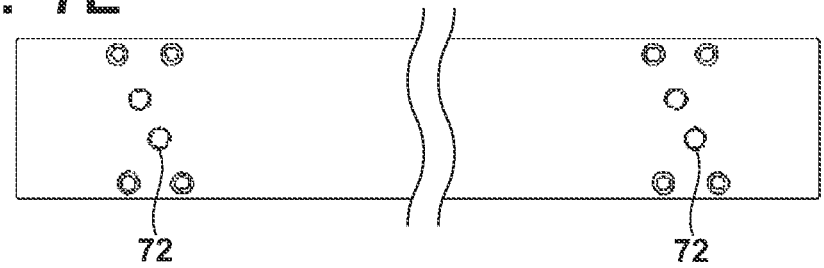

FIG. 7A shows a surface of the first channel member 50 on a side on which the discharge module 200 is mounted. FIG. 7B is a view showing a rear surface of the first channel member 50 on a side on which the first channel member 50 contacts the second channel member 60. The first channel member 50 is provided in correspondence with each discharge module 200, and a plurality of first channel members 50 are arrayed. This divided structure can cope with the length of the liquid discharge head by arraying a plurality of modules. For example, this structure can be preferably applied especially to a relatively long-scale liquid discharge head corresponding to B2 size or more. As shown in FIG. 7A, communication ports 51 of the first channel member 50 fluidly communicate with the discharge module 200. As shown in FIG. 7B, individual communication ports 53 of the first channel member 50 fluidly communicate with communication ports 61 of the second channel member 60. FIG. 7C shows a surface of the second channel member 60 on a side on which the second channel member 60 contacts the first channel member 50. FIG. 7D shows a section of the second channel member 60 at the center in the direction of thickness. FIG. 7E is a view showing a surface of the second channel member 60 on a side on which the second channel member 60 contacts the supply unit 220.

One of common channel grooves 71 of the second channel member 60 is the common supply channel 211 shown in FIGS. 3 and 4, and the other is the common collection channel 212. Ink flows from one end to the other end in the longitudinal direction of the liquid discharge head 3.

Figure 8:
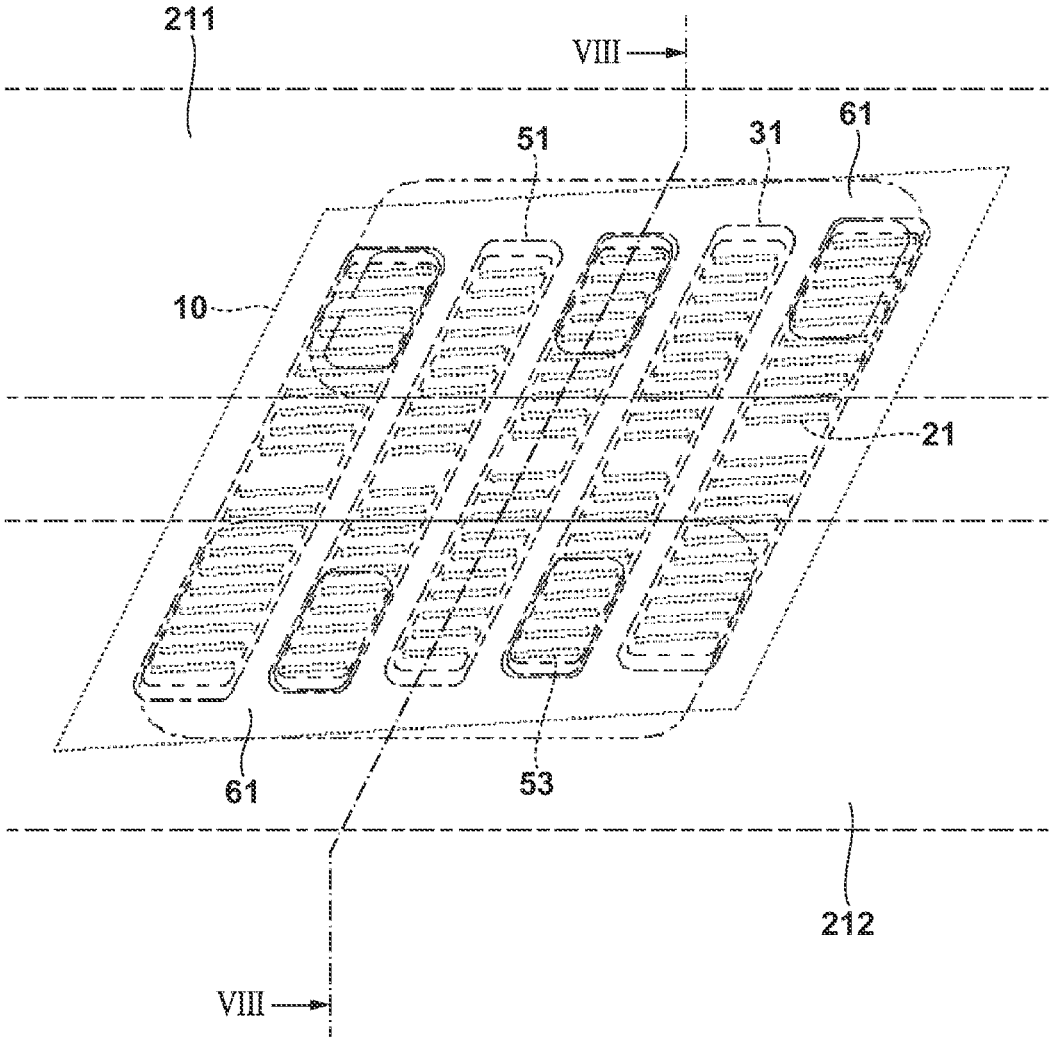
FIG. 8 is a perspective view showing the connection relationship between a printing element substrate and the channel member.

FIG. 8 is a perspective view showing the connection relationship between the printing element substrate 10 and the channel member 210. As shown in FIG. 8, a pair of the common supply channel 211 and the common collection channel 212 extending in the longitudinal direction of the liquid discharge head 3 is provided in the channel member 210. The communication ports 61 of the second channel member 60 are aligned with the individual communication ports 53 of the respective first channel members 50 and are connected to them, forming supply paths that communicate with the communication ports 51 of the first channel members 50 from communication ports 72 of the second channel member 60 via the common supply channel 211. Similarly, collection paths that communicate with the communication ports 51 of the first channel members 50 from the communication ports 72 of the second channel member 60 via the common collection channel 212 are formed.

Figure 9:
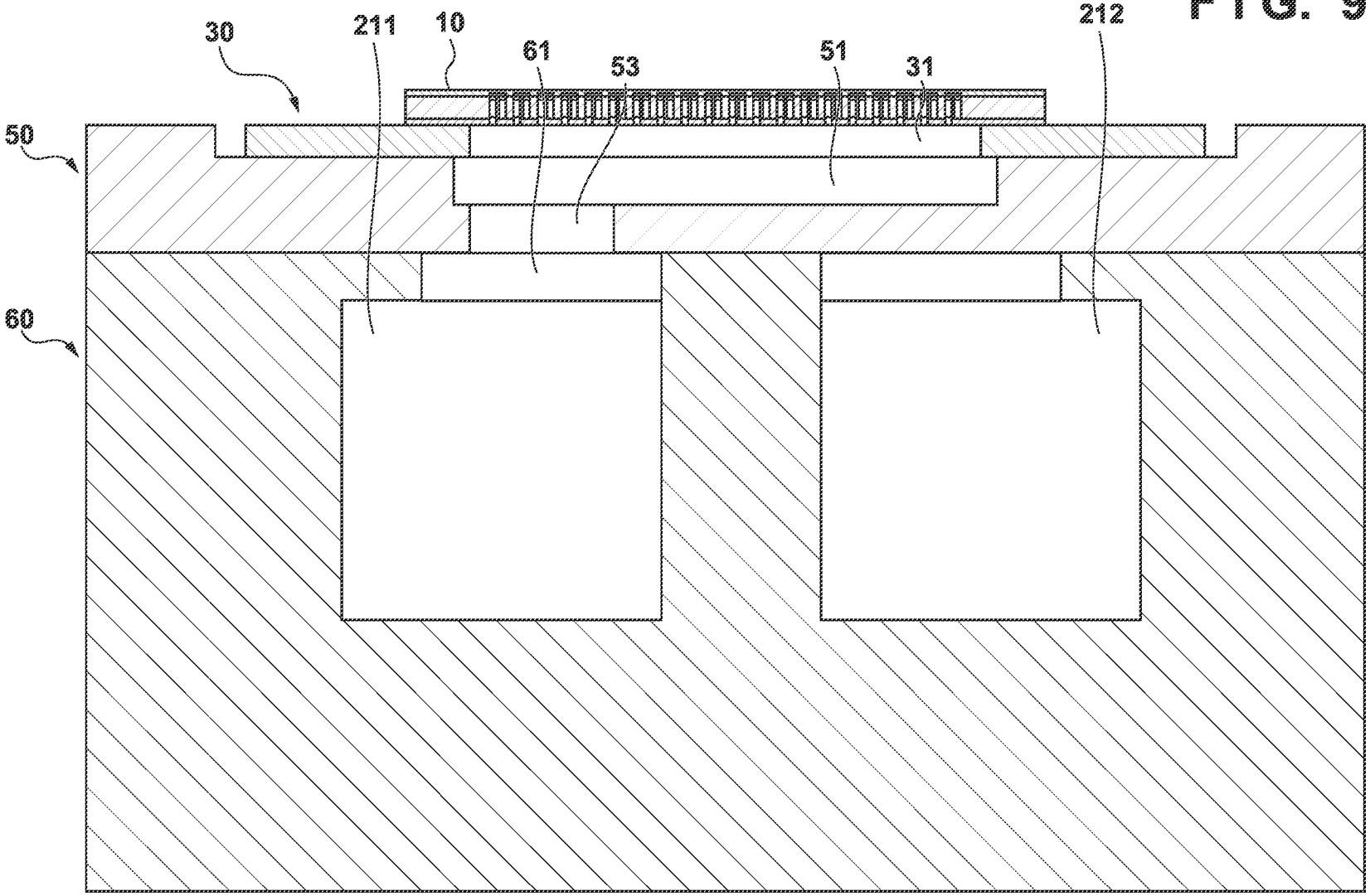
FIG. 9 is a view showing the section of the channel member.

FIG. 9 is a view showing a section taken along a line VIII-VIII in FIG. 8. As shown in FIG. 9, the common supply channel 211 is connected to the discharge module 200 via the communication port 61, the individual communication port 53, and the communication port 51. That is, the individual supply channel 213*a* (FIGS. 3 and 4) includes the communication port 61, the individual communication port 53, and the communication port 51. Although not shown in FIG. 9, it is apparent from FIG. 8 that the individual collection channel 213*b* is connected to the discharge module 200 via a similar path in another section. Each printing element substrate 10 has a channel communicating with orifices 13 so that part or all of supplied ink can flow back through the orifices 13 (a pressure chamber 23) at which a discharge operation suspends. The common supply channel 211 is connected to the negative-pressure control unit 230 (high-pressure side) via the supply unit 220, and the common collection channel 212 is connected to the negative-pressure control unit 230 (low-pressure side) via the supply unit 220. The pressure difference generates a flow in which ink flows from the common supply channel 211 to the common collection channel 212 through the orifices 13 (pressure chamber 23) of the printing element substrate 10. The arrangement of the printing element substrate 10 will be described with reference to FIGS. 12A to 12D and the like.

(Discharge Module)

Figure 10A:
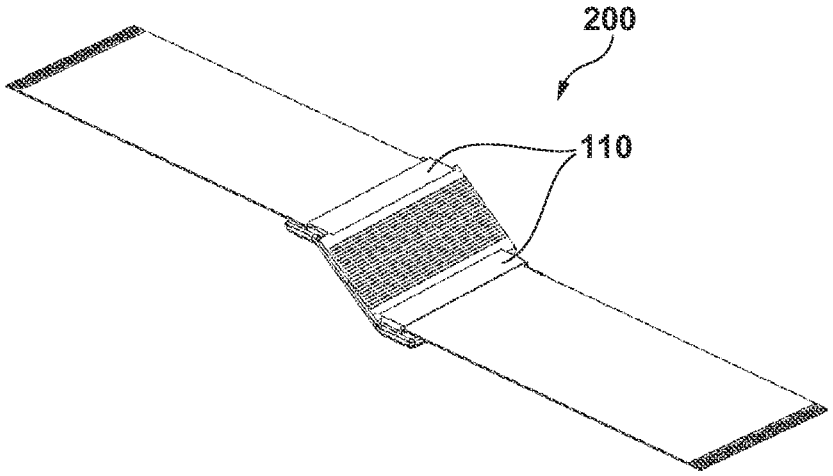
FIGS. 10A and 10B are perspective views of a discharge module.
Figure 10B:
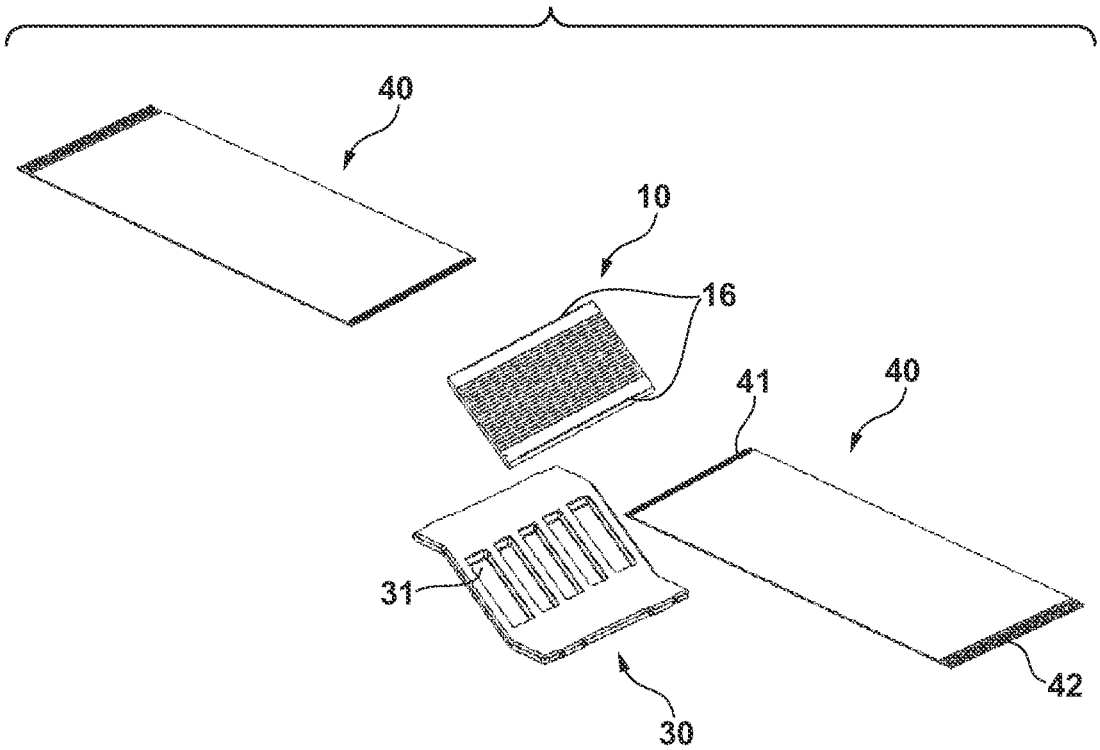

FIG. 10A is a perspective view of one discharge module 200, and FIG. 10B is an exploded view of it. The discharge module 200 includes the printing element substrate 10, a support member 30, and the flexible wiring boards 40.

An example of a method of manufacturing the discharge module 200 will be described. First, the printing element substrate 10 and the flexible wiring boards 40 are bonded onto the support member 30 having communication ports 31. Then, terminals 16 on the printing element substrate 10 and terminals 41 on the flexible wiring boards 40 are electrically connected by wire bonding, and the wire bonding portions (electrical connecting portions) are covered with the sealing members 110 and sealed. Terminals 42 of the flexible wiring boards 40 on sides opposite to the printing element substrate 10 are electrically connected to connecting terminals of the electric wiring substrate 90. The support member 30 is a support that supports the printing element substrate 10, and is also a channel member that makes the printing element substrate 10 and the channel member 210 fluidly communicate with each other. Hence, the support member 30 is preferably a member that is very flat and can be joined to the printing element substrate 10 highly reliably. Preferable examples of the support member 30 are alumina and a resin material.

Note that the plurality of terminals 16 are arranged on two sides of the printing element substrate 10 along the direction of orifice arrays (on respective long sides of the printing element substrate 10), and two flexible wiring boards 40 electrically connected to the terminals 16 are arranged for one printing element substrate 10. This arrangement can shorten the maximum distance from the terminal 16 to the printing element (heating element), and reduce a voltage drop and a signal transmission delay generated at the wiring portion within the printing element substrate 10.

(Recovery Mechanism)

A recovery unit 4 is provided for the liquid discharge head 3 according to this embodiment. The recovery unit 4 has a mechanism of recovering the discharge performance of the liquid discharge head 3. This mechanism includes a wiper mechanism for wiping the ink discharge surface of the liquid discharge head 3, and a suction mechanism for sucking ink in the liquid discharge head 3 from the ink discharge surface at negative pressure, in addition to the above-mentioned cap 1007 that caps the ink discharge surface of the liquid discharge head 3.

As described above, the liquid discharge heads 3 have the same printing width in the widthwise direction of the print medium 2, and have the same number of printing element substrates 10 arrayed at a pitch in the array direction.

Figure 11:
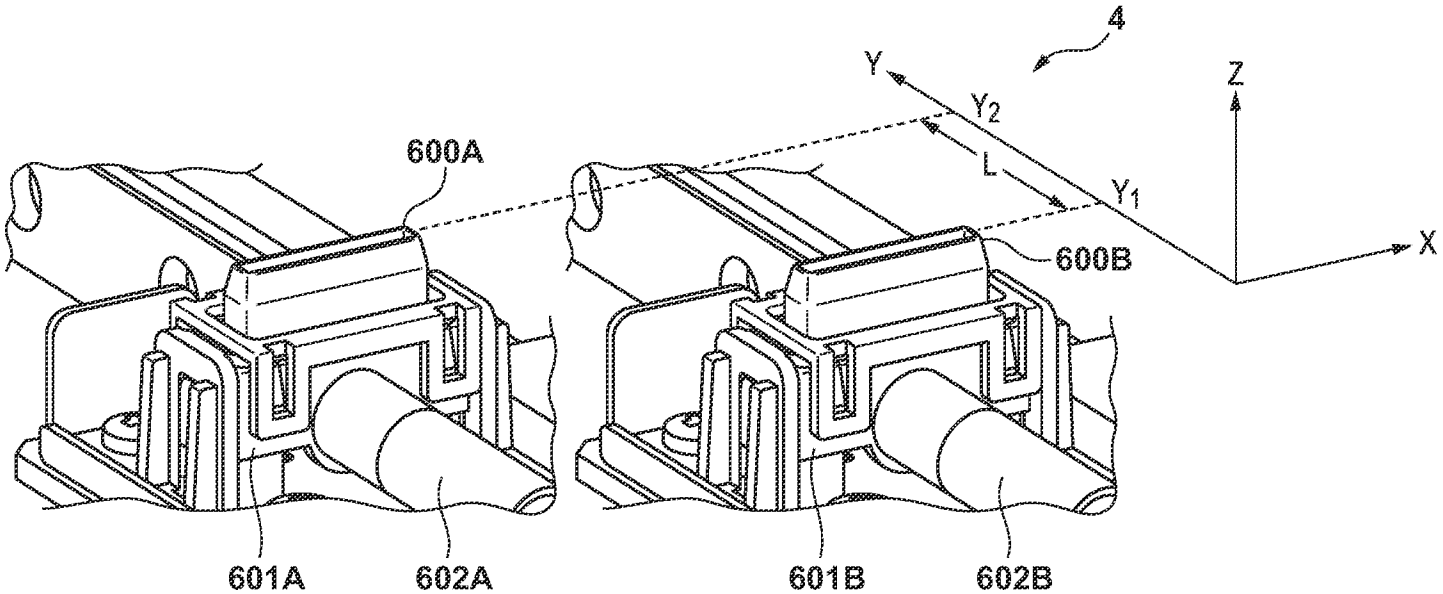
FIG. 11 is a perspective view of a suction wiper.

FIG. 11 is a perspective view showing the arrangement of a suction wiper provided as the recovery unit 4. In FIG. 11, the X-axis represents a direction parallel to the conveyance direction of the print medium 2, the Y-axis represents the widthwise direction perpendicular to the conveyance direction, and the Z-axis represents the top-to-bottom direction perpendicular to the conveyance direction. FIG. 11 shows a relationship in which two suction wipers 600A and 600B are arranged respectively in correspondence with two liquid discharge heads 3 for descriptive convenience. Although two suction wipers will be exemplified, the number of provided suction wipers may change in accordance with the number of liquid discharge heads 3.

As shown in FIG. 11, the positions of the suction wipers 600A and 600B in the Y-axis direction are Y2 and Y1, respectively. The two suction wipers are provided at a distance L between the two positions. The two suction wipers 600A and 600B are fixed to corresponding holders 601A and 601B, respectively. When a suction recovery operation (suction operation) starts, the two holders simultaneously move from one end to the other end of the liquid discharge head 3 in the Y-axis direction by the same driving source (driving motor: not shown), and perform suction recovery of the two liquid discharge heads 3.

More specifically, the two holders of the two suction wipers 600 move up in the Z-axis direction at one end of the two liquid discharge heads 3, and the suction ports of the two suction wipers 600 come into contact with the ink discharge surfaces of the two corresponding liquid discharge heads 3. After that, a suction pump (not shown) is driven to generate a negative pressure in the suction ports. Suction recovery is performed to wipe the ink discharge surfaces and suck ink while moving the two holders 601A and 601B in the Y-axis direction. Note that waste ink sucked by this suction recovery operation is discharged via tubes 602A and 602B respectively provided to the two holders 601A and 601B. In this embodiment, one suction pump (not shown) is provided as a common negative-pressure generating source for two suction wipers and is configured to generate a suction force. The suction wiper 600 may be configured to be able to perform the suction operation on forward and return paths in the scanning direction.

(Printing Element Substrate)

Figure 12A:
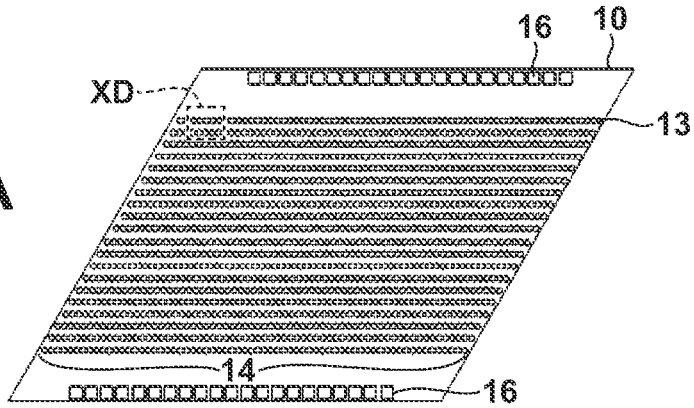
FIGS. 12A to 12D are plan views of a printing element substrate.
Figure 12B:
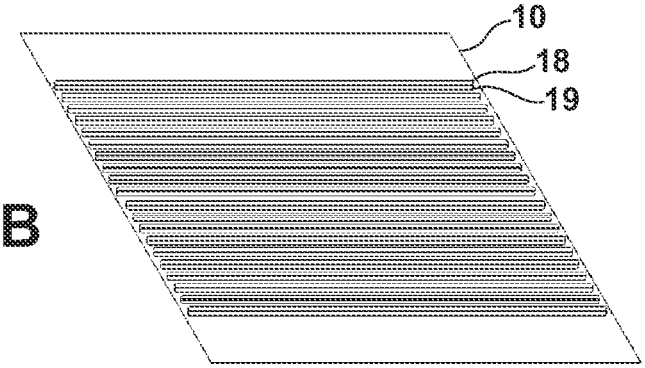
Figure 12C:
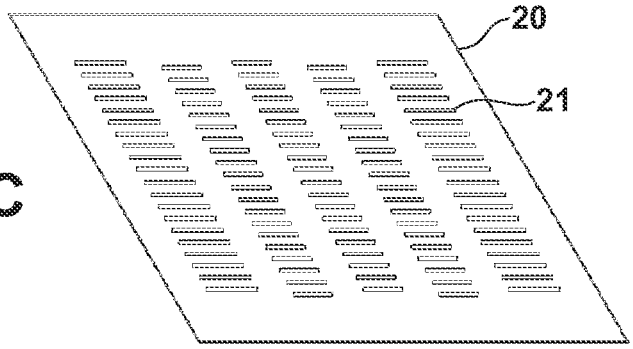
Figure 12D:
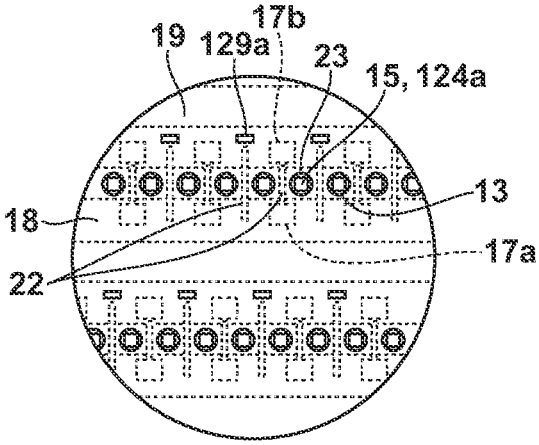
Figure 13:
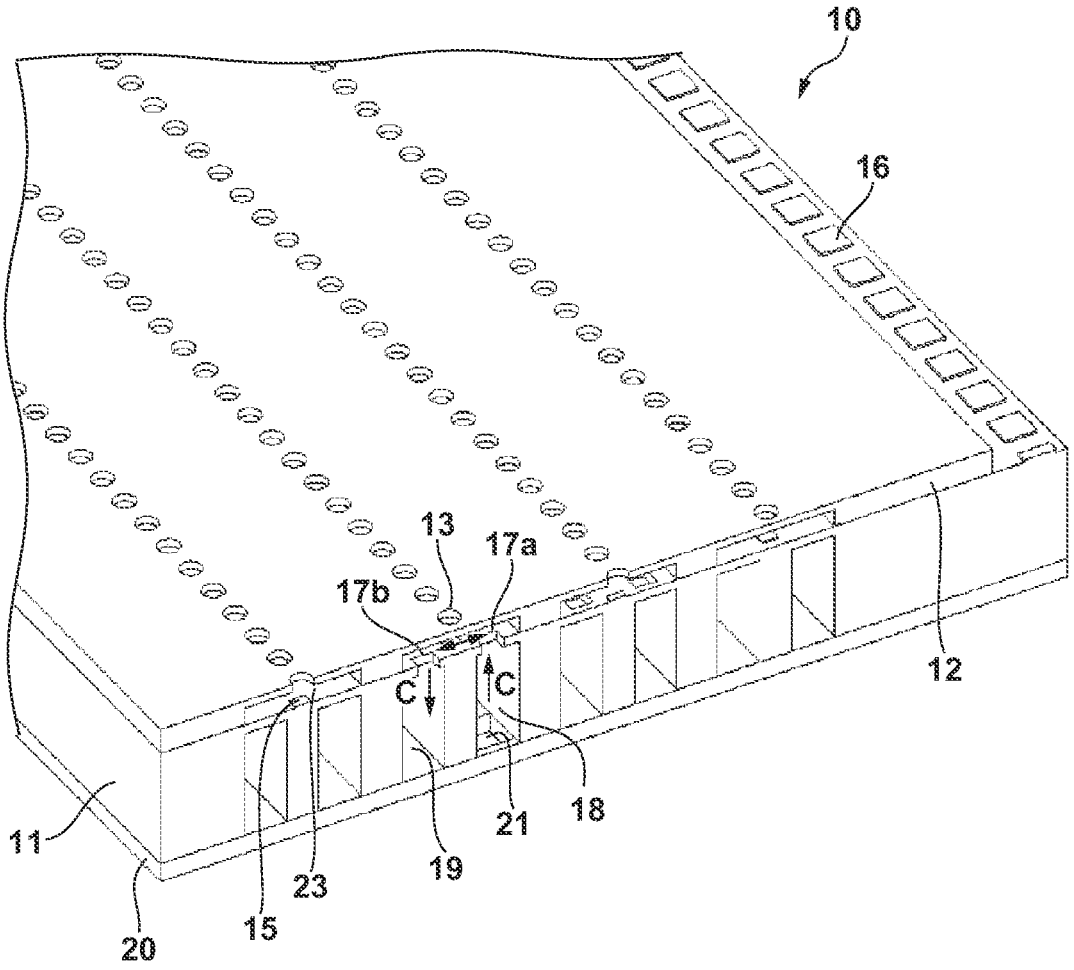
FIG. 13 is a perspective view showing the section of the printing element substrate.

FIG. 12A is a schematic view of a surface of the printing element substrate 10 serving as a liquid discharge head substrate on a side on which the orifices 13 are arranged. FIG. 12C is a schematic view showing a surface opposite to the surface in FIG. 12A. FIG. 12B is a schematic view showing the surface of the printing element substrate 10 when a lid member 20 provided on the rear surface side of the printing element substrate 10 is removed in FIG. 12C. FIG. 12D is an enlarged view of a portion surrounded by a broken line XD in FIG. 12A. FIG. 13 is a perspective view showing the section of the printing element substrate 10.

The printing element substrate 10 includes a substrate 11 constituted by stacking a plurality of layers on a silicon base 120, an orifice forming member 12 formed from a photosensitive resin, and the lid member 20 joined to the rear surface of the substrate 11. A plurality of orifice arrays 14 are formed in the orifice forming member 12 of the printing element substrate 10. Note that a direction in which the orifice array 14 of the orifices 13 runs will be called an "orifice array direction". Printing elements 15 are formed on the substrate 11, and grooves constituting supply paths 18 and collection paths 19 extending in the orifice array direction are formed on the rear surface side. The printing element 15 is an element that generates energy used to discharge a liquid. As shown in FIG. 12B, the supply paths 18 and the collection paths 19 extending in the orifice array direction are provided on the rear surface of the printing element substrate 10. Each supply path 18 is provided on one side of the orifice array 14, and each collection path 19 is provided on the other side. The supply paths 18 and the collection paths 19 are provided alternately in a direction that intersects the orifice array direction.

As shown in FIG. 12D, a plurality of supply ports 17*a* connected to each supply path 18 are arrayed in the orifice array direction to form a supply port array, and a plurality of collection ports 17*b* connected to each collection path 19 are arrayed to form a collection port array.

As shown in FIGS. 12C and 13, the sheet-like lid member 20 is stacked on the rear surface of the substrate 11 opposite to the surface on which the orifice forming member 12 is provided. The lid member 20 has a plurality of openings 21 communicating with the supply paths 18 and the collection paths 19. Each opening 21 provided in the lid member 20 communicates with the communication port 51 of the first channel member 50 via the communication port 31 of the support member 30. The lid member 20 functions as a lid that forms part of the walls of the supply paths 18 and collection paths 19 formed in the substrate 11 of the printing element substrate 10. The lid member 20 preferably has high corrosion resistance to ink, and the opening shape and opening position of the opening 21 require high precision. To achieve this, a photosensitive resin material or a silicon plate is preferably used as the material of the lid member 20, and the opening 21 is preferably provided by a photolithographic process. The lid member 20 converts the pitch of the channel by the opening 21, is desirably thin in consideration of the pressure drop, and is desirably formed from a film-like member.

Note that the liquid discharge head 3 according to this embodiment uses a full-line head constituted by linking and arranging in the Y-axis direction a plurality of printing element substrates 10 of the same size with a parallelogram shape to obtain a large printing width. However, the shape of the head substrate need not always be the parallelogram, and a plurality of rectangular head substrates may be arranged side by side in the Y-axis direction. Alternatively, a plurality of trapezoidal head substrates may be arranged in the Y-axis direction while staggering the positions of the upper and lower sides.

As shown in FIG. 12D, the printing elements 15 are arranged at positions corresponding to the orifices 13 as heat generating resistors configured to bubble ink by thermal energy. Partitions 22 partition the pressure chambers 23 each incorporating the printing element 15. The printing element 15 is electrically connected to the terminal 16 in FIG. 12A by an electrical wire provided on the printing element substrate 10. The printing element 15 generates heat based on a pulse signal input from the control circuit of the printing apparatus 1000 via the electric wiring substrate 90 (FIG. 6) and the flexible wiring boards 40 (FIGS. 10A and 10B), thereby boiling ink. The ink is discharged from the orifice 13 by the power of bubbling by boiling. Although the printing element 15 is covered with a plurality of layers provided on the substrate 11, which will be described later, it is schematically illustrated on the surface of the substrate 11 in FIGS. 12D and 13.

Next, the flow of ink in the printing element substrate 10 will be described. Each supply path 18 and each collection path 19 formed by the substrate 11 and the lid member 20 are connected to the common supply channel 211 and the common collection channel 212 in the channel member 210, respectively. A pressure difference is generated between the supply path 18 and the collection path 19. When ink is discharged from the orifices 13 of the liquid discharge head 3, the pressure difference causes ink to flow from the supply path 18 to the collection path 19 via the supply port 17*a*, the pressure chamber 23, and the collection port 17*b* at the orifice 13 at which no discharge operation is performed (arrows C in FIG. 13). By this flow, ink thickened by evaporation from the orifice 13, bubbles, a foreign substance, and the like can be collected to the collection path 19 at the orifice 13 and the pressure chamber 23 at which printing stops. Further, thickening of ink at the orifice 13 and the pressure chamber 23 can be suppressed. The ink collected to the collection path 19 is collected sequentially to the communication port 51 of the channel member 210, the individual collection channel 213*b*, and the common collection channel 212 via the opening 21 of the lid member 20 and the communication port 31 (FIG. 9) of the support member 30, and is finally collected to the supply path of the printing apparatus 1000.

As shown in FIGS. 3 and 4, not all ink flowing from one end of the common supply channel 211 of the discharge unit 300 is supplied to the pressure chamber 23 via the individual supply channel 213*a*. In other words, part of ink flows not into the individual supply channel 213*a* but into the supply unit 220 from the other end of the common supply channel 211. Since the path through which ink flows without passing through the printing element substrate 10 is provided, the backflow of the circulation flow of ink can be suppressed even on the printing element substrate 10 having a fine channel of high flow resistance as in this embodiment. In the liquid discharge head 3 according to this embodiment, thickening of ink near the pressure chamber 23 and the orifice 13 can be suppressed, non-uniform discharge and a discharge failure can be suppressed, and high-quality printing can be performed.

Figure 14A:
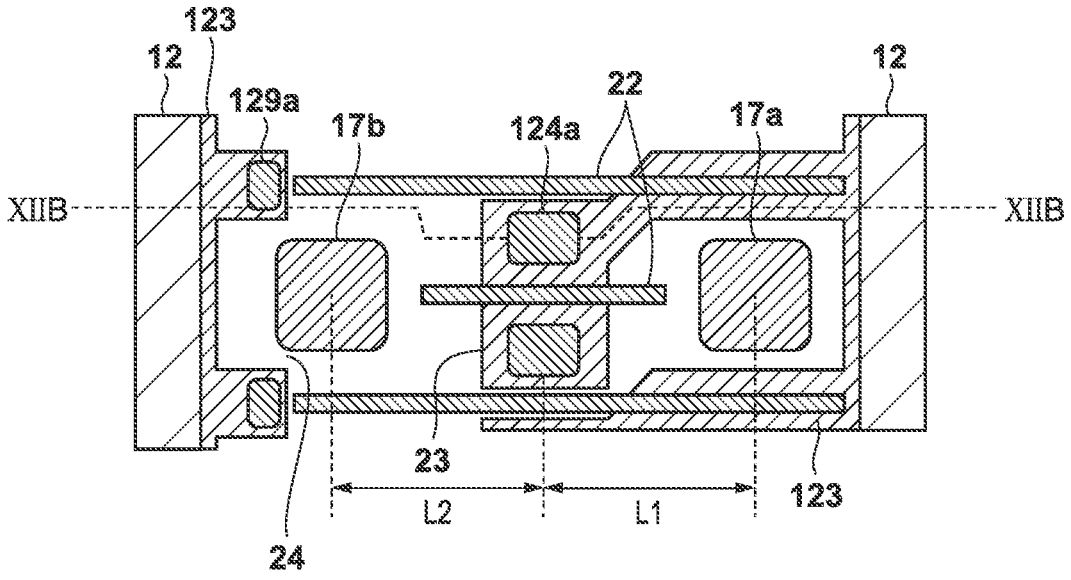
FIGS. 14A and 14B are views showing a printing element substrate according to the first embodiment.
Figure 14B:
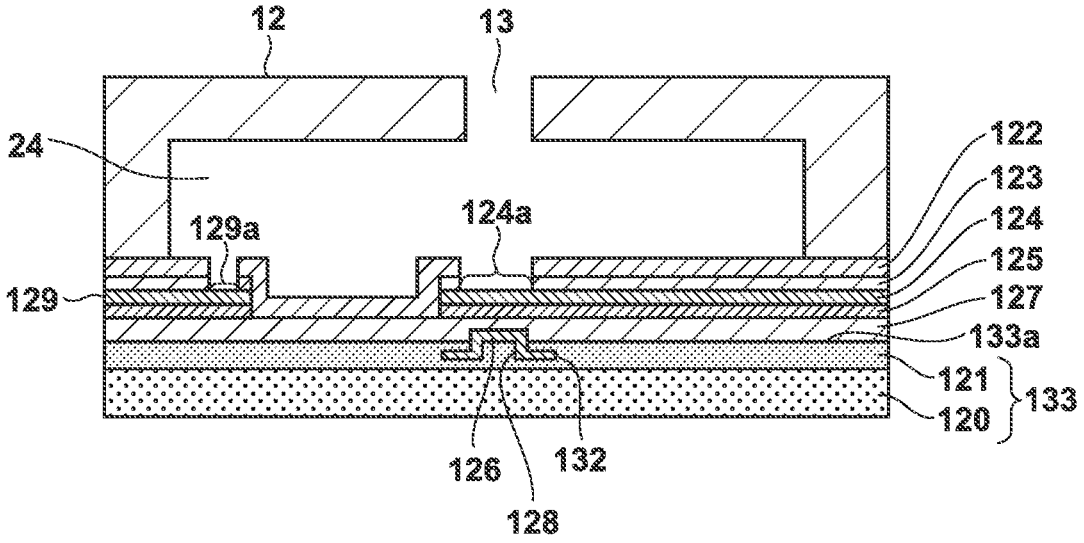

FIG. 14A is an enlarged plan view schematically showing a portion around a heat acting portion 124*a* on a surface of the printing element substrate 10 on which the heat acting portion 124*a* is provided. FIG. 14B is a schematic sectional view taken along a line XIIB-XIIB in FIG. 14A. Note that a second contact layer 122 shown in FIG. 14B is not illustrated in FIG. 14A. The heat acting portion 124*a* is a portion that contacts ink and applies heat to it to bubble the ink.

The substrate 11 included in the printing element substrate 10 is formed by stacking a plurality of layers on the silicon base 120. In this embodiment, a thermal storage layer 121 formed from a thermal oxide film, an SiO (silicon monoxide) film, an SiN (silicon nitride) film, or the like is arranged on the silicon base 120. A heat generating resistor 126 serving as the printing element 15 is arranged on the thermal storage layer 121. A base 133 includes the silicon base 120 and the thermal storage layer 121, and a heat generating resistor 126 is arranged on a surface 133*a* side of the base 133. An electrode wiring layer 132 serving as a wire formed from a metal material such as Al (aluminum), Al—Si (aluminum-silicon alloy), or Al—Cu (aluminum-copper alloy) is connected to the heat generating resistor 126 via plugs 128 formed from tungsten or the like. A pair of plugs 128 is arranged with respect to the heat generating resistor 126. A portion of the heat generating resistor 126 through which a current flows via the plugs 128 functions as a heating unit. The plugs 128 and the electrode wiring layer 132 are formed inside the thermal storage layer 121. An insulating protection layer 127 is arranged on the heat generating resistor 126 to cover the heat generating resistor 126. The insulating protection layer 127 is formed from, for example, an SiO film, an SiN film, or the like.

A first protection layer 125 and a second protection layer 124 are arranged on the insulating protection layer 127. These protection layers have a function of protecting the surface of the heat generating resistor 126 from chemical and physical shocks accompanying heat generation of the heat generating resistor 126. For example, the first protection layer 125 is formed from tantalum (Ta), and the second protection layer 124 is formed from iridium (Ir). The protection layers formed from these materials are conductive.

A first contact layer 123 and the second contact layer 122 are arranged on the second protection layer 124. The first contact layer 123 has a function of improving the adhesion between the second protection layer 124 and another layer. The first contact layer 123 is formed from, for example, tantalum (Ta). The second contact layer 122 has functions of protecting another layer from ink and improving the adhesion with the orifice forming member 12. The second contact layer 122 is formed from, for example, SiC (silicon carbide) or SiCN (nitrogen-added silicon carbide).

The orifice forming member 12 is joined to a surface of the substrate 11 on the second contact layer 122 side, and forms a channel 24 including the pressure chamber 23 together with the substrate 11. The channel 24 includes the supply port 17*a* and the collection port 17*b*, and is a region surrounded by the orifice forming member 12 and the substrate 11. The orifice forming member 12 has the partitions 22 each provided between the adjacent heat acting portions 124*a*. The partition 22 partitions the pressure chamber 23.

When discharging ink, the ink temperature rises instantaneously and the ink bubbles and debubbles to generate cavitation at the heat acting portion 124*a* of the second protection layer 124 that covers the heat generating resistor 126 and contacts the ink. Thus, the second protection layer 124 including the heat acting portion 124*a* is formed from iridium with high corrosion resistance and high cavitation resistance. The heat acting portion 124*a* of the second protection layer 124 is arranged between the supply port 17*a* and the collection port 17*b* when viewed from a direction perpendicular to the surface 133*a* of the base 133. Note that "arranged between the supply port 17*a* and the collection port 17*b*" means that at least part of the heat acting portion 124*a* is positioned between the supply port 17*a* and the collection port 17*b*.

Electrodes 129*a* used for kogation generation suppression processing (to be described later) are arranged on the downstream side of the heat acting portion 124*a* of the second protection layer 124 in the flow direction of ink from the supply port 17*a* to the collection port 17*b* in the channel 24. In other words, the electrodes 129*a* are arranged on the collection port 17*b* side with respect to the heat acting portion 124*a*. When the supply ports 17*a* are arranged on one side of the heat acting portions 124*a* in the array direction and the collection ports 17*b* are arranged on the other side, as shown in FIG. 12D, the electrodes 129*a* are arranged on the collection port 17*b* side with respect to the array of the heat acting portions 124*a*. To suppress the load of the manufacturing process, an electrode layer 129 constituting the electrodes 129*a* is preferably formed from the same material (iridium in this case) as that of the second protection layer 124.

[Kogation Generation Suppression Processing]

In this embodiment, kogation generation suppression processing is performed to suppress kogation deposited on the second protection layer 124 on the heat generating resistor 126 in the ink discharge operation. More specifically, the heat acting portion 124*a* of the second protection layer 124 serves as the first electrode, the electrode 129*a* provided in the same channel 24 as that of the heat acting portion 124*a* serves as the second electrode, and these paired electrodes are used to form an electric field in ink. For this purpose, the heat acting portion 124*a* of the second protection layer 124 and the electrode 129*a* are electrically connected to the terminal 16 of the printing element substrate 10 via the internal wire of the printing element substrate 10, and a potential can be applied to the heat acting portion 124*a* and the electrode 129*a* from the outside of the printing element substrate 10. In kogation generation suppression processing according to this embodiment, an electric field is formed in ink between the heat acting portion 124*a* and the electrode 129*a* in a state in which no current flows between the heat acting portion 124*a* and the electrode 129*a* via the ink.

At this time, particles serving as a kogation factor are moved apart from the heat acting portion 124*a* by forming an electric field so that the particles such as a pigment (color material) and an additive contained in ink and charged at a negative potential are repulsed from the heat acting portion 124*a* of the second protection layer 124. Kogation is a phenomenon in which a pigment (color material) or an additive is heated to high temperature, decomposed on the molecular level, changes to a hardly-soluble substance, and is physically adsorbed onto the heat acting portion 124*a* of the second protection layer 124. Kogation deposited on the heat acting portion 124*a* of the second protection layer 124 on the heat generating resistor 126 can be suppressed by decreasing the abundance of particles such as a pigment charged at a negative potential near the heat acting portion 124*a* of the second protection layer 124. Even when ink contains particles charged to a positive potential, an electric field is formed between the heat acting portion 124*a* and the electrode 129*a* so that the particles charged to a positive potential are repulsed from the heat acting portion 124*a*.

As described above, an ink flow is generated in the pressure chamber 23 to supply ink from the supply port 17*a* and collect it through the collection port 17*b*. That is, ink circulation is performed in the channel 24 including the pressure chamber 23 to collect, through the collection port 17*b*, ink supplied from the supply port 17*a*. This ink circulation is performed when at least the ink discharge operation is performed.

As described above, the electrode 129*a* is arranged on the downstream side of the heat acting portion 124*a* of the second protection layer 124 in the flow direction of ink from the supply port 17*a* to the collection port 17*b*. Charged particles serving as a kogation factor near the heat acting portion 124*a* of the second protection layer 124 receive repulsion from the heat acting portion 124*a* by an electric field formed in ink and also receive inertial force toward the electrode 129*a* by the flow of ink. This can further decrease the abundance of charged particles near the heat acting portion 124*a* heated at the time of ink discharge. In this manner, generation of kogation can be further suppressed by arranging the electrode 129*a* on the downstream side of the heat acting portion 124*a* in the flow direction of ink circulation, and performing kogation generation suppression processing in which an electric field is formed in ink while supplying ink, and charged particles are repulsed from the heat acting portion 124*a*.

In this embodiment, the electrode 129*a* is not arranged between the heat acting portion 124*a* of the second protection layer 124 and the collection port 17*b*, but is arranged at a position spaced apart from the heat acting portion 124*a* with respect to an edge of the collection port 17*b* on a side close to the heat acting portion 124*a*. This arrangement of the electrode 129*a* can suppress an increase in a distance L2 between the heat acting portion 124*a* and the collection port 17*b*. In addition, a distance L1 between the heat acting portion 124*a* and the supply port 17*a*, and the distance L2 between the heat acting portion 124*a* and the collection port 17*b* can be shortened to be equal to each other. After bubbling for ink discharge, ink is supplied from both the supply port 17*a* and the collection port 17*b*, the ink filling time can be shortened, and quick driving of the liquid discharge head 3 can be implemented.

Since ink is supplied from both the supply port 17*a* and the collection port 17*b* after bubbling for ink discharge, as described above, the flow of ink in the channel 24 temporarily changes immediately after bubbling. Then, the ink flows from the supply port 17*a* to the collection port 17*b*. The flow direction of ink is not the temporarily changed flow direction of ink, but a steady flow direction from the supply port 17*a* to the collection port 17*b*.

A voltage may be applied between the heat acting portion 124*a* and the electrode 129*a* to repulse charged particles from the heat acting portion 124*a*. That is, a potential may be applied to the heat acting portion 124*a* side, and the potential of the electrode 129*a* may be grounded. Alternatively, a potential may be applied to both the heat acting portion 124*a* and the electrode 129*a*.

The potential of the electrode 129*a* with respect to the heat acting portion 124*a* is preferably equal to or higher than +0.50 V in order to efficiently repulse particles charged at a negative potential from the heat acting portion 124*a*. When the heat acting portion 124*a* and the electrode 129*a* contain iridium, the potential of the electrode 129*a* with respect to the heat acting portion 124*a* is preferably equal to or lower than +2.5 V. This is because, if the potential becomes higher than +2.5 V, an electrochemical reaction may occur between the electrode 129*a* and ink and iridium contained in the electrode 129*a* to elute iridium into the ink. As a result, a current flows between the heat acting portion 124*a* and the electrode 129*a* via the ink. Hence, when performing kogation generation suppression processing, a current is prevented from flowing between two electrodes via ink while an electric field is formed in the ink between the heat acting portion 124*a* and the electrode 129*a*.

[Bubble Generation in Kogation Generation Suppression Processing]

If an upper protection layer 107 is eluted by an electrochemical reaction to remove kogation on the heat acting portion in the above-described way, bubbles are generated along with the reaction. The generated bubbles may prevent uniform elution of the upper protection layer 107 into ink. Particularly in recent years, an inkjet head in which the droplet size of discharged ink is several pL to 1 pL, or 1 pL or less is implemented or proposed. If the above-described kogation removal method is directly applied in the case of a very small ink droplet size, bubbles generated by an electrochemical reaction may partially inhibit a reaction between the upper protection layer 107 and ink, and uniform and reliable kogation removal may not be performed satisfactorily.

To solve this, this embodiment employs a cleaning method in which voltage application to the upper protection layer 107 for eluting the upper protection layer 107 by an electrochemical reaction is performed after the start of an ink suction operation. Since bubbles generated by the electrochemical reaction do not grow large and are discharged by ink suction, kogation can be removed uniformly and reliably.

[Kogation Removal Experiment]

Effects of this embodiment verified by performing experiments regarding a kogation removal operation with respect to a form in which a liquid discharge head 3 having a discharged ink droplet volume of 5 pL was used, and a comparative example will be explained. A kogation removal experiment was conducted using the liquid discharge head 3 and the cleaning method according to this embodiment. As the experimental method, kogation removal processing was executed by driving a heating unit under predetermined conditions so as to deposit kogation on a heat acting portion 108, and then energizing the upper protection layer 107. Ink used was BCI-6e M (available from Canon).

Figure 16A:
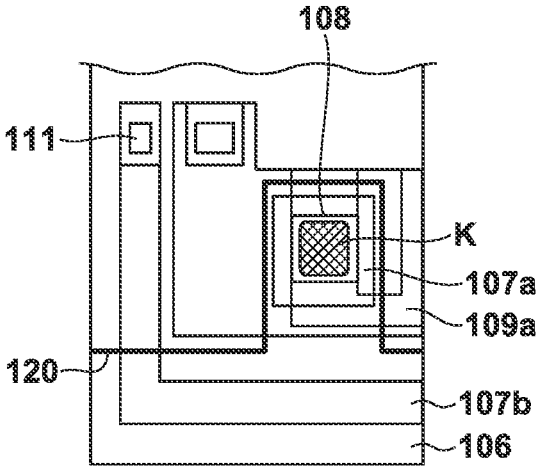
FIGS. 16A to 16D are explanatory views showing the state of the upper protection layer of an electrothermal transducer.

First, a 1.5-μs wide driving pulse at a voltage of 20 V was applied to the heating portion (printing element 15) $5.0\times10^6$ times at a frequency of 5 kHz. As shown in FIG. 16A, an impurity K called kogation was deposited almost uniformly on the heat acting portion 108. When printing was performed using the liquid discharge head 3 in this state, it was confirmed that the printing quality was degraded by the deposition of the kogation K. Although it is described that the kogation is generated "on the heat acting portion 108" for descriptive convenience, the kogation can be generated around the heat acting portion 108.

Figure 17A:
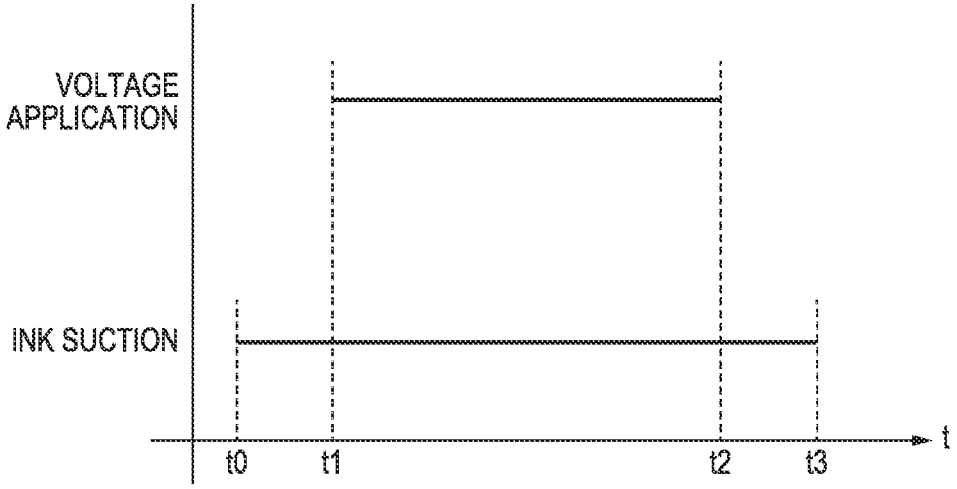
FIGS. 17A and 17B are timing charts showing the timings of a potential application operation and suction operation.

Then, a 10-V DC voltage was applied to the connecting portion 111 connected to the upper protection layer 107 for 30 sec. At this time, a region 107*a* of the upper protection layer 107 was an anode electrode, and a region 107*b* was a cathode electrode. As shown in the timing chart of FIG. 17A, suction recovery was started using a recovery pump at t=t0 before the start of an electrochemical reaction by applying the DC voltage at t=t1. In FIG. 17A, the abscissa represents the lapse of time. While forcibly discharging bubbles generated from the region 107*a* of the upper protection layer 107 together with ink along with the voltage application, kogation removal processing by elution of the upper protection layer 107 was executed till t2. Note that the suction recovery ended at t3 after the end of applying the DC voltage. That is, in FIG. 17A, the ink suction is performed during the period between t0 and t3, and the application of the DC voltage is performed during the period between t1 and t2.

Figure 16B:
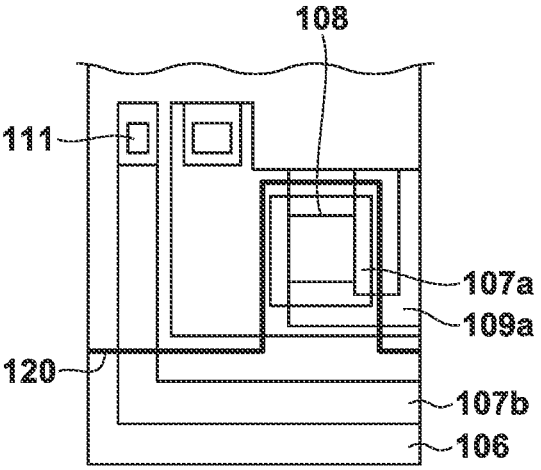

As shown in FIG. 16B, it was confirmed that the deposited kogation K was removed from the heat acting portion 108 by the kogation removal operation. When printing was performed using the liquid discharge head 3 in this state, it was confirmed that the printing quality was recovered to a state almost equal to the initial one.

This result reveals that, by performing during ink suction an electrochemical reaction for eluting the upper protection layer 107, bubbles generated by the electrochemical reaction are discharged together with ink without attaching to the upper protection layer 107. Even when the ink droplet is as small as several pL or less, the electrochemical reaction between ink and the upper protection layer 107 is not inhibited, elution to the ink is performed uniformly and reliably, and kogation removal becomes possible even in long-term use.

Figure 16C:
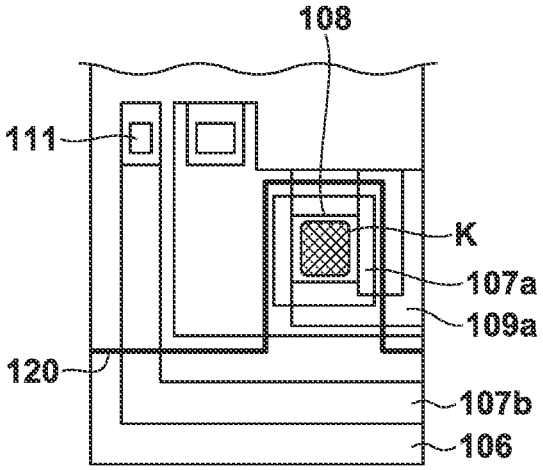

Next, to confirm a phenomenon as the comparative example, kogation removal processing was executed by starting ink suction using a recovery pump after the start of voltage application for an electrochemical reaction. Note that the ink suction operation was performed till the end of voltage application. That is, in the form shown in FIG. 17A, control was performed so that the ink suction period included the voltage application period. In the comparative example, control was performed so that t1 temporally precedes t0. First, a 1.5-μs wide driving pulse at a voltage of 20 V was applied to the heating portion (printing element 15) $5.0\times10^6$ times at a frequency of 5 kHz. As shown in FIG. 16A, the impurity K called kogation was deposited almost uniformly on the heat acting portion 108. When printing was performed using the liquid discharge head 3 in this state, it was confirmed that the printing quality was degraded by the deposition of the kogation K. Although kogation removal processing was executed under the above-described conditions, part of the kogation K remained deposited as shown in FIG. 16C, unlike this embodiment.

Figure 16D:
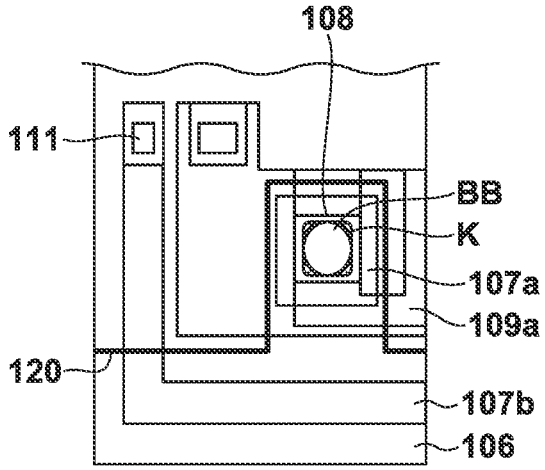

To confirm the generation of this phenomenon, ink suction was stopped during voltage application and the region of the upper protection layer 107 was observed. As is apparent from FIG. 16D, a bubble BB generated by the electrochemical reaction was attached to the upper protection layer 107. It is considered that the kogation in this region was not removed because the bubble BB inhibited the electrochemical reaction between the upper protection layer 107 and ink. To the contrary, no bubble was attached to a partial region of the upper protection layer 107, so the reaction proceeded and the kogation K attached to this partial region was removed. However, a voltage for the electrochemical reaction was intensively applied to a portion that contacted ink, that is, a location where the electrochemical reaction was not inhibited by the bubble. As a result, the upper protection layer 107 in this region was excessively eluded into the ink after the long-term use, and the film thickness of the uniform upper protection layer 107 could not be maintained.

FIG. 18A shows the experimental results. As the printing quality, it is determined based on a predetermined criterion whether the quality of a printed material is satisfactory. As is apparent from the experimental results shown in FIG. 18A, to uniformly and reliably elute the upper protection layer 107, it is proper to cause an electrochemical reaction while executing ink suction. Especially when the volume of ink droplet to be discharged is several pL or less, the kogation removal method should be selected in which the upper protection layer 107 is eluted while discharging generated bubbles together with ink without growing the bubbles until they inhibit a reaction between the upper protection layer 107 and the ink.

As described above, ink recovery processing is started before the start of an electrochemical reaction with the upper protection layer 107. This can prevent reaction inhibition by bubbles generated by the electrochemical reaction and can elute the upper protection layer 107 uniformly and reliably. If t0<t1, as shown in FIG. 17A, the above-described effects can be obtained. In general, when an electrode material is eluted into a solution by an electrochemical reaction, a so-called electrical double layer is formed near the electrode surface at almost the same time as voltage application, and then the elution reaction proceeds. The time taken to form the electrical double layer is on the order of 0.01 sec. Even when the time t1 to start voltage application and the time t0 to start ink suction are t0=t1 in FIG. 17A, the effects of the above-mentioned cleaning method can be obtained.

[Shortening of Suction Time]

If the time t1 to start voltage application and the time t0 to start ink suction are t0≤t1, as described above, reaction inhibition by bubbles generated by an electrochemical reaction can be prevented, and the upper protection layer 107 can be eluted uniformly and reliably. However, the time t2 to end voltage application and the time t3 to end ink suction are t2≤t3, that is, even the discharge operation ends after the end of potential application, so ink is kept discharged while the potential application is executed. As the ink suction time becomes longer, the waste ink amount becomes larger. In this embodiment, it is controlled to prevent reaction inhibition while shortening the time of the ink suction operation.

(Selection of Suction Timing)

An experiment to search for a proper suction timing at which reaction inhibition could be suppressed by a minimum ink suction operation was performed. More specifically, a voltage for kogation removal processing was applied for 30 sec. The presence/absence of ink suction and whether a reaction of the kogation removal processing was satisfactorily performed at the timing were determined. FIG. 18B shows the results.

The experimental results shown in FIG. 18B reveal that when no ink suction operation is performed, a kogation removal reaction is inhibited by bubbles generated at the time of reaction and is not satisfactorily performed. In addition, generated bubbles become excessively large 5 sec and 25 sec after voltage application and inhibit the reaction, similar to the case in which no voltage is applied. However, when the suction operation is performed 10 to 20 sec after a voltage is applied, bubbles do not grow large enough to inhibit the reaction, and the reaction necessary for kogation removal control is performed satisfactorily. In other words, the reaction necessary for kogation removal control is or is not satisfactorily performed depending on the time elapsed after the start time of voltage application.

Figure 17B:
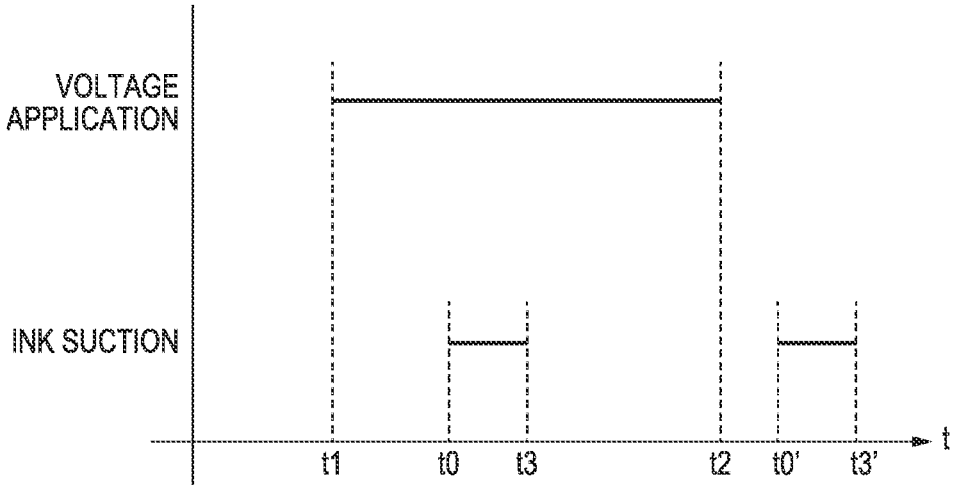

According to the present invention, control is performed in consideration of the time elapsed after the start timing of voltage application, as shown in FIG. 17B. In FIG. 17B, the period between t1 and t2 is a period during which a voltage is applied. The period between t0 and t3 and the period between t0' and t3' are periods during which ink suction is performed. The timings t0 and t0' are defined as timings a predetermined time (10 sec to 20 sec) after the start timing of application based on the results shown in FIG. 18B. The period between t0 and t3 and the period between t0' and t3' are defined as times necessary for kogation and bubble discharge. Note that the period between t0 and t3 and the period between t0' and t3' may be equal or different.

[Operation Sequence in Kogation Removal Processing]

As described above, many bubbles are generated when a high potential is applied for kogation removal processing. If ink circulation is executed in such a state, the bubbles move to the back of the orifice and it becomes difficult to discharge them. This may cause a longer-term discharge failure.

Hence, at the time of kogation removal processing, ink circulation needs to be stopped temporarily, and bubble-containing ink needs to be discharged before the start of ink circulation. As the discharge means, ink suction is executed in this embodiment.

In this embodiment, the suction operation is performed by a suction wiper 600. Steps S2 to S5 in FIG. 15 (to be described later) are performed for every three printing element substrates 10. That is, a potential is simultaneously applied to three printing element substrates 10, and suction is performed on orifices sequentially by the suction wiper 600 while the suction wiper 600 contacts the potential-applied printing element substrates 10. It is desirable to perform the suction operation in the period of a predetermined time (10 sec to 20 sec) from the start of voltage application, as shown in FIG. 18B. Thus, the suction wiper 600 is so scanned as to suck the three printing element substrates 10 at the timing of the suction operation. The suction operation is performed on all chips by performing kogation removal processing in steps S2 to S5 of FIG. 15 on all the printing element substrates 10 and then scanning the suction wiper 600 from one end to the other end in the longitudinal direction of the line head in step S6. Note that the number of printing element substrates 10 to be sucked by the suction wiper 600 is not limited to the above-described one, and can be changed in accordance with a processing speed (scanning speed) that can be coped with by the printing apparatus 1000, the number of printing element substrates 10, and the like.

Figure 15:
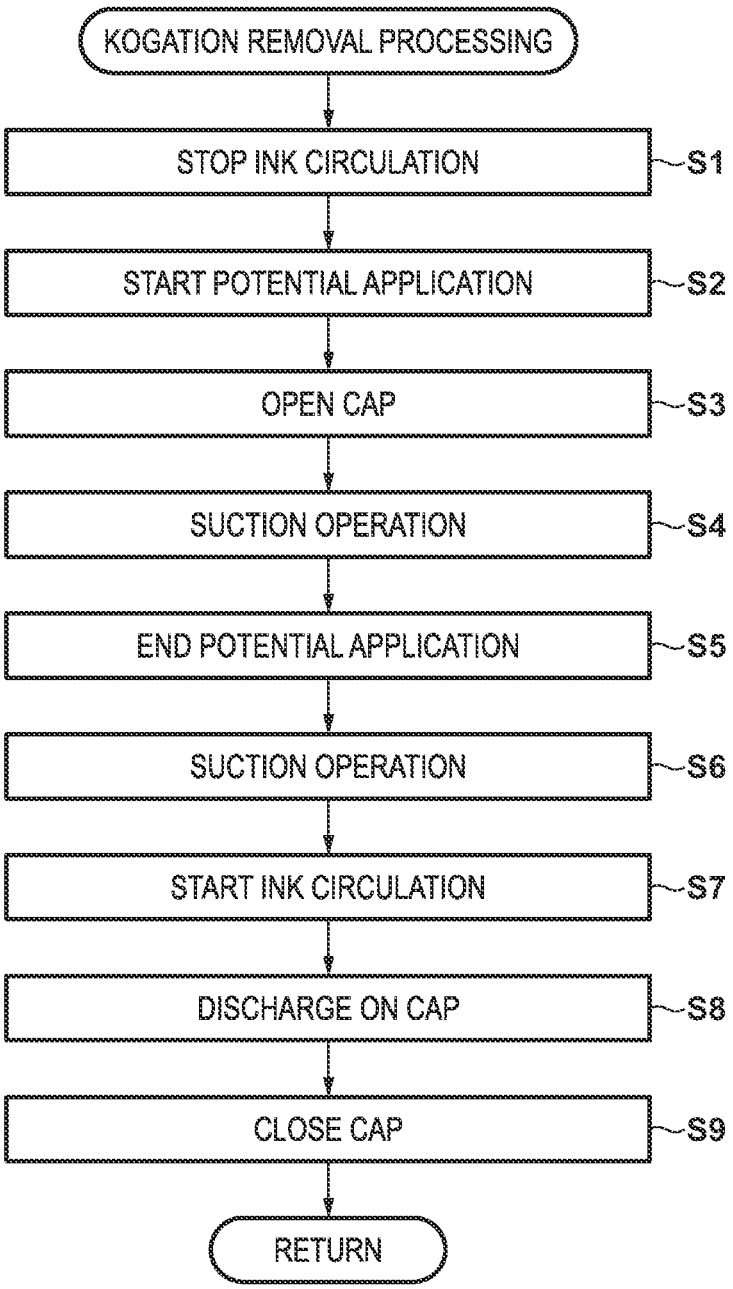
FIG. 15 is a flow chart showing an operation sequence.

FIG. 15 shows the sequence of a printing operation to be executed by the printing apparatus 1000 according to this embodiment. The printing unit 400B according to this embodiment controls this operation. For descriptive convenience, the main body of this operation is the printing unit 400B here. At the start of this processing, the cap 1007 is attached to the liquid discharge head 3.

In step S1, if a kogation removal processing instruction is input to the printing apparatus 1000, the printing unit 400B stops ink circulation in the channel 24 of the liquid discharge head 3. More specifically, various pumps shown in FIGS. 3 and 4 are controlled to stop supply of ink into the liquid discharge head 3.

In step S2, the printing unit 400B sequentially starts potential application to the processing target printing element substrates 10 of the liquid discharge head 3. This potential is a potential for kogation removal processing, and a potential shown in FIG. 18A is applied in this embodiment.

In step S3, the printing unit 400B detaches the cap 1007 from the liquid discharge head 3.

In step S4, the printing unit 400B starts the suction operation on the liquid discharge head 3. The start timing is a timing shown in FIGS. 17B and 18B. When performing the suction operation simultaneously on a plurality of printing element substrates 10 (three in this example), as described above, the scanning of the suction wiper 600 is so controlled as to perform the suction operation within the period shown in FIG. 18B.

In step S5, the printing unit 400B repeats the processing till the end of kogation removal processing on all the chips of the liquid discharge head 3. In this case, the periods of ink suction and voltage application are controlled to have a relationship shown in FIG. 17B in performing kogation removal processing on each printing element substrate 10.

In step S6, the printing unit 400B starts the suction operation again after the end of kogation removal processing on all the printing element substrates 10, and removes bubbles generated by the kogation removal processing. The timings of the suction operation are the timings t0' to t3' in FIG. 17B.

In step S7, the printing unit 400B resumes ink circulation after the end of bubble removal. More specifically, various pumps shown in FIGS. 3 and 4 are controlled to start supply of ink into the liquid discharge head 3. Accordingly, the liquid discharge head 3 is filled with the ink and the ink is circulated.

In step S8, the printing unit 400B discharges the ink from the liquid discharge head 3 onto the cap 1007. The ink can be discharged from the orifices 13 of the liquid discharge head 3 in preparation for next printing.

In step S9, the printing unit 400B attaches the cap 1007 to the liquid discharge head 3 after the end of the discharge operation. The processing sequence then ends.

As described above, according to this embodiment, removal of kogation on the element substrate of the liquid discharge head is enabled, and longer-term stable discharge can be implemented while implementing stable discharge by circulation. In addition, the amount of waste ink can be reduced by restricting the suction operation.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-148714, filed Aug. 7, 2018, which is hereby incorporated by reference herein in its entirety.

What is claimed is:

1. An inkjet printing apparatus comprising:

a discharge head including orifices configured to discharge ink, a channel communicating with the orifices, a heating element configured to generate thermal energy for discharging the ink in the channel, a protection layer having a surface exposed to the channel and covering the heating element, and an electrode having a surface exposed to the channel;

a tank configured to store the ink to be supplied to the discharge head;

an ink circulation unit configured to perform a circulation operation of circulating the ink between the discharge head and the tank; and a kogation removal unit configured to perform a removal operation of removing kogation generated around the heating element by applying a voltage between the protection layer and the electrode, wherein the kogation removal unit performs the removal operation in a state in which the circulation operation is stopped.

2. The apparatus according to claim 1, wherein the circulation operation by the ink circulation unit is performed after the removal operation by the kogation removal unit is stopped.

3. The apparatus according to claim 1, further comprising a suction unit configured to perform a suction operation sucking ink from the orifices, wherein the suction unit performs the suction operation a predetermined time after applying the voltage between the protection layer and the electrode in the removal operation by the kogation removal unit.

4. The apparatus according to claim 3, wherein the suction unit performs the suction operation after an end of the removal operation by the kogation removal unit and before the circulation operation by the ink circulation unit is resumed.

5. The apparatus according to claim 3, wherein the discharge head has an orifice surface on which the orifices are arrayed in a first direction in an area corresponding to a width of a printing medium, and the suction unit is a suction wiper configured to contact the orifice surface and suck while moving in the first direction.

6. The apparatus according to claim 1, wherein the discharge head includes a plurality of heating elements, and the kogation removal unit performs the removal operation on a predetermined number of heating elements at once.

7. The apparatus according to claim 1, wherein the discharge head includes a supply port communicating with the channel and configured to supply the ink to the orifices, a supply channel configured to supply the ink to the supply port, a collection port communicating with the channel and configured to collect the ink from the orifices, and a collection channel configured to collect the ink from the collection port, and the ink circulation unit performs the circulation operation to cause the ink to flow through the supply channel, the orifices, and the collection channel.

8. A method of controlling an inkjet printing apparatus including a discharge head including orifices configured to discharge ink, a channel communicating with the orifices, a heating element configured to generate thermal energy for discharging the ink in the channel, a protection layer having a surface exposed to the channel and covering the heating element, and an electrode having a surface exposed to the channel, and a tank configured to store the ink to be supplied to the discharge head, the method comprising:

performing a circulation operation of circulating the ink between the discharge head and the tank; and performing a removal operation on kogation generated around the heating element by applying a voltage between the protection layer and the electrode in a state in which the performing of the circulation operation is stopped.

9. The method according to claim 8, wherein the performing of the circulation operation is performed after the performing of the removal operation is stopped.

10. The method according to claim 8, further comprising performing a suction operation sucking ink from the orifices, wherein the performing of the suction operation is performed a predetermined time after applying the voltage between the protection layer and the electrode in the performing of the removal operation.

11. The method according to claim 10, wherein the performing of the suction operation is performed after an end of the performing of the removal operation and before the performing of the circulation operation is resumed.

12. The method according to claim 10, wherein the discharge head has an orifice surface on which the orifices are arrayed in a first direction in an area corresponding to a width of a printing medium, and the suction operation is performed by a suction wiper configured to contact the orifice surface and suck while moving in the first direction.

13. The method according to claim 8, wherein the discharge head includes a plurality of heating elements, and the performing of the removal operation is performed on a predetermined number of heating elements at once.

14. The method according to claim 8, wherein the discharge head includes a supply port communicating with the channel and configured to supply the ink to the orifices, a supply channel configured to supply the ink to the supply port, a collection port communicating with the channel and configured to collect the ink from the orifices, and a collection channel configured to collect the ink from the collection port, and in the performing of the circulation operation, the circulation operation is performed to cause the ink to flow through the supply channel, the orifices, and the collection channel.

* * * * *